US007946260B2

(12) United States Patent
von Mayenburg

(10) Patent No.: US 7,946,260 B2
(45) Date of Patent: May 24, 2011

(54) INTERNAL COMBUSTION ENGINE WITH VARIABLE COMPRESSION RATIO

(76) Inventor: Michael von Mayenburg, Villach-Landskron (AT)

( * ) Notice: Subject to any disclaimer, the term of this patent is extended or adjusted under 35 U.S.C. 154(b) by 625 days.

(21) Appl. No.: 12/011,494

(22) Filed: Jan. 25, 2008

(65) Prior Publication Data

US 2008/0314368 A1 Dec. 25, 2008

Related U.S. Application Data

(60) Provisional application No. 61/003,498, filed on Nov. 16, 2007, provisional application No. 60/936,741, filed on Jun. 22, 2007, provisional application No. 60/958,352, filed on Jul. 3, 2007.

(51) Int. Cl.
*F02B 75/04* (2006.01)

(52) U.S. Cl. ..... 123/48 B; 123/78 BA

(58) Field of Classification Search ..... 123/48 B, 123/78 B, 78 BA

See application file for complete search history.

(56) References Cited

U.S. PATENT DOCUMENTS

| | | | |
|---|---|---|---|
| 1,112,832 | A | 10/1914 | Pierce |
| 1,386,114 | A | 8/1921 | Jedrzykowski |
| 1,463,474 | A | 7/1923 | Lazier |
| 1,931,705 | A | 5/1930 | Peterson |
| 2,151,853 | A | 3/1939 | Jonville et al. |
| 2,153,691 | A | 4/1939 | Hironaka |
| 4,215,660 | A | 8/1980 | Finley |
| 4,864,975 | A | 9/1989 | Hasegawa |
| 5,025,757 | A | 6/1991 | Larsen |
| 5,146,879 | A | 9/1992 | Kume et al. |
| 5,406,911 | A | 4/1995 | Hefley |
| 5,417,185 | A | 5/1995 | Beattie |
| 5,562,068 | A | 10/1996 | Sugimoto et al. |
| 5,595,146 | A | 1/1997 | Bollig et al. |
| 5,732,673 | A | 3/1998 | Mandella |
| 5,908,014 | A | 6/1999 | Leithinger |
| 5,960,750 | A | 10/1999 | Kreuter |
| 6,394,048 | B1 | 5/2002 | Styron |
| 6,732,683 | B2 | 5/2004 | Weiss |
| 6,966,282 | B2 | 11/2005 | Hirano |
| 7,191,741 | B2 | 3/2007 | Hiyoshi et al. |
| 2002/0002957 | A1 | 1/2002 | Moteki et al. |
| 2003/0075125 | A1 | 4/2003 | Kreuter |
| 2005/0150471 | A1 | 7/2005 | Styron |

OTHER PUBLICATIONS

International Search Report and Written Opinion of the International Searching Authority, mailed Dec. 10, 2008, for corresponding International Application No. PCT/US2008/005883.

*Primary Examiner* — Noah Kamen
(74) *Attorney, Agent, or Firm* — Klarquist Sparkman, LLP

(57) ABSTRACT

A coupler, such as a piston pin, is pivotally coupled to a piston such that the piston can pivot about a first axis relative to the coupler. A connecting rod is coupled to the coupler for pivoting about a second axis. The relative positions of the first and second axes can be shifted by pivoting an eccentric portion of the coupler to thereby vary the compression ratio of a piston cylinder within which the piston slides. The coupler comprises a pivot member engager portion that is selectively shifted from first to second positions to vary the compression rates in response to shifting of a pivot member. The pivot member engager is shifted from first to second positions as the piston approaches the bottom dead center position. The pivot member and pivot member engager disengage from one another as the piston travels away from the bottom dead center position.

51 Claims, 15 Drawing Sheets

INTERNAL COMBUSTION ENGINE WITH VARIABLE COMPRESSION RATIO

CROSS-REFERENCE TO RELATED APPLICATIONS

This application claims the benefit of U.S. Provisional Application No. 61/003,498, titled "Internal Combustion Engine With Variable Compression Ratio," filed Nov. 16, 2007, and claims the benefit of U.S. Provisional Application No. 60/936,741, titled "Internal Combustion Engine With Variable Compression Ratio" and filed Jun. 22, 2007, and also claims the benefit of U.S. Provisional Application No. 60/958,352, titled "Internal Combustion Engine With Variable Compression Ratio" and filed Jul. 3, 2007; all of which are incorporated herein by reference.

FIELD

The technology disclosed herein relates to methods and apparatus for adjusting the compression ratio of an internal combustion engine, such as for gasoline and diesel fueled engines.

BACKGROUND

Gasoline engines are typically designed so that under full load (open throttle) no uncontrolled combustion (knocking) occurs which limits the combustion ratio. Under throttled conditions, the gasoline engine is under compressed which can reduce engine efficiency. Diesel engines are typically over compressed to enhance starting in cold conditions. Diesel engines that have warmed up would be more efficient if they had a lower compression ratio. Thus, a variable compression ratio engine can be operated under various operating conditions to vary the engine compression so as to, for example, increase engine efficiency. A need exists for an improved variable compression ratio engine and related methods.

SUMMARY

In accordance with aspect of one embodiment of internal combustion engine, a piston coupler is pivotable about a first axis and pivotally couples a piston to a connecting rod with the piston being slidable in an associated piston cylinder in response to rotation of a crank shaft coupled to the connecting rod. The piston is reciprocated between top dead center and bottom dead center positions. The piston coupler comprises a first coupling portion pivotally coupled to the piston such that the piston is pivotable about a first axis and a second coupler portion pivotally coupled to the connecting rod such that the connecting rod is pivotable about a second axis. One of the first and second coupler portions comprises an eccentric portion operable such that pivoting of the piston coupler about the first axis from a first coupler position to a second coupler position pivots the eccentric portion from a first eccentric position to a second eccentric position and shifts the second axis relative to the first axis to thereby vary the compression ratio of the associated piston cylinder. The piston coupler can also comprise a pivot member engager. As another aspect of the embodiment, a pivot member is provided and comprises a pivot coupler engager movable from a first pivot coupler engager position to a second pivot coupler engager position and positioned to engage the pivot member engager to pivot the piston coupler from the first coupler position to the second coupler position as the piston approaches the bottom dead center position and in response to such movement of the pivot coupler engager. As another aspect of this embodiment, the pivot coupler engager is disengaged from the pivot member engager as the piston travels away from bottom dead center position.

In accordance with another aspect of an embodiment, a pivot member can be pivotable about a pivot member axis for pivoting movement from first to second pivot member positions in response to movement of the pivot coupler engager from first to second positions so as to result in corresponding movement of the piston coupler from first to second coupler positions to thereby vary the compression of the engine.

As another aspect of an embodiment, the pivot member engager can comprise at least one pivot member engagement surface which, for example, can be flat or planar and the pivot member can comprise at least one pivot member engagement surface which can also be flat or planar.

In a more specific embodiment, the pivot member is pivotable about a pivot member axis and comprises two pivot member engagement surfaces respectively positioned at opposite sides of the pivot member axis and the first axis and wherein there is a first set of two pivot coupler engagement surfaces on opposite sides of the pivot member axis. In accordance with another aspect of an embodiment, a plurality of pistons are provided with a common pivot member being provided to engage the pivot member engagement surfaces of the couplers associated with the pistons in the respective first and second piston cylinders. A first bracket positioned at least in part in the first cylinder and a second bracket positioned at least in part within the second cylinder can be used to support respective ends of the common pivot member. A first set of two pivot coupler engagement surfaces can be provided at one end portion of the common pivot member and a second set of two pivot coupler engagement surfaces can be provided at the opposite end portion of the common pivot member.

In accordance with a further aspect of an embodiment, the piston coupler can comprise a piston pin pivotable about the first axis with exemplary forms of piston pins being described in greater detail below. In one specific embodiment, the piston pins include internal cavities. These internal cavities can include a first cavity at one end portion of the piston pin that can be at least in part conical, a second cavity at an opposite end portion of the pivot pin that can also be at least in part conical, and an internal passageway extending therebetween. These passageways can be dimensioned and positioned to provide a homogeneous bending line in response to the application of force by the piston to the piston pin and the counterforce applied by the connecting rod during operation of an engine.

In accordance with another aspect of an embodiment, the piston coupler comprises a piston pin. A piston associated with a cylinder can comprise a body having an upper cylindrical piston ring supporting portion of a first diameter and a lower body portion sized to create a pivot member engager receiving space between the lower body portion and the associated cylinder. One end portion of the piston pin can extend outwardly from the lower body portion into the pivot member engager receiving space, said one end portion of the piston pin can comprise a pivot member engager.

As yet another aspect of an embodiment, the pivot members can be selectively driven to cause pivoting of the pivot members to thereby vary the compression ratio of the engine. In a specific example, a motor can be coupled to a worm gear which operably engages a pivot member to pivot the pivot member between various positions to adjust the compression ratio to a plurality of values depending upon the position to which the pivot member has been pivoted. A single motor can be coupled to a plurality of pivot member drivers, such as to plural worm gears, such as a respective worm gear for driving each pivot member. As another aspect of an embodiment, a worm gear associated with a pivot member can engage a pivot member to restrict movement of a pivot member in either direction along a pivot member axis about which the pivot member can be pivoted. In a more specific aspect, the pivot member can define a recess extending in a direction perpendicular to the pivot member axis with the worm gear being positioned at least partially in the recess and engaging the pivot member to restrict movement of the pivot member in either direction along the pivot member axis.

Pivoting of the pivot member can be limited to be within predetermined limits such as by configuring a worm gear drive for the pivot member. In addition, a mechanism can be provided for limiting the extent of pivoting of the pivot coupler about the first axis to be within a predetermined limit.

In accordance with yet another aspect of an embodiment, a piston coupler retainer can be coupled to the piston coupler to apply a retention force to resist pivoting of the piston coupler. The piston coupler retainer can also limit pivoting of the pivot coupler about the first axis to be within a predetermined limit. The piston coupler retainer can comprise a friction brake having a braking surface received within a braking surface defining cavity of the piston coupler.

As a still further aspect of an embodiment, an internal combustion engine is provided wherein a piston cylinder has a longitudinal centerline and wherein the maximum eccentricity is defined as E and corresponds to the maximum offset between the first and second axes, wherein an origin of a reference coordinate system is at the intersection of the longitudinal centerline of the at least one piston cylinder and a bottom dead centerline corresponding the second axis when the second axis is in the bottom dead center position, wherein the Z dimension is along the longitudinal center line of the piston cylinder from the origin and the X dimension is along the bottom dead centerline from the origin, wherein the pivot member axis is parallel to the first axis and, wherein the pivot member axis intersects an area wherein X is from −0.5 E to −0.8 E and Z is from −0.25 E to 0.25 E.

As yet another aspect of an embodiment, an internal combustion engine comprises at least one piston cylinder with a longitudinal centerline, wherein the longitudinal centerline is positioned between a first line parallel to the longitudinal centerline that intersects the first axis and a second line parallel to the longitudinal centerline that intersects the second axis when the eccentric portion is pivoted to the maximum allowed extent.

As a further aspect of an embodiment, an internal combustion engine is provided wherein the maximum eccentricity is defined as E and corresponds to the maximum offset between the first and second axes arising from pivoting the eccentric portion, wherein the piston coupler comprises a piston pin comprising first and third portions and a second portion intermediate the first and third portions, the first and third portions having longitudinal centerlines that are aligned with the first axis, the second portion comprising the eccentric portion and having a longitudinal center line that is aligned with the second axis, the first, second and third portions comprising right cylindrical surfaces, the second portion having a right cylindrical surface of a first diameter defined as $R_{CR}$, one of the first and third portions having a right cylindrical surface of a diameter $R_1$, wherein $R_1 \geqq (R_{CR}+E)$, and the other of the first and third portions having a right cylindrical surface of a diameter $R_2$, wherein $R_2 \leqq (R_{CR}-E)$.

As a still a further specific aspect of an embodiment, an internal combustion engine is provided wherein there are first and second of said piston cylinders, a respective associated first piston slidably received by the first of said piston cylinders, a respective associated second piston slidably received by the second of said piston cylinders, a respective connecting rod and piston coupler associated with and coupled to said first piston, a respective connecting rod and piston coupler associated with and coupled to the second piston, and wherein there is a common pivot member for engaging the piston couplers associated with the first and second pistons. The common pivot member can comprise a first set of two pivot coupler engagement surfaces for engaging two pivot member engagement surfaces of the piston coupler associated with the first piston and a second set of two pivot coupler engagement surfaces for engaging two pivot member engagement surfaces of the piston coupler associated with the second piston. The common pivot member can comprise a first pivot member end portion extending into a first region defined by the first cylinder and a second pivot member end portion extending into a second region defined by the second cylinder. A first bracket can be coupled to the first cylinder in a position to pivotally support the first pivot member end portion and a second bracket can be coupled to the second cylinder in a position to pivotally support the second pivot member end portion. The first and second brackets can be fastened together with a portion of the first cylinder and a portion of the second cylinder positioned between the first and second brackets. The first and second brackets are configured to provide clearance for the respective pivot member engagement surfaces and pivot coupler engagement surface to engage one another.

As yet another aspect of an embodiment, the piston coupler can define a piston coupler braking surface. A spring biased friction brake can be coupled to the at least one piston and can comprise a friction brake with a braking surface positioned to frictionally engage the piston coupler braking surface. As a more specific aspect of an embodiment, each of the piston coupler braking surface and friction brake braking surface can be at least partially conical. The piston coupler can comprise a piston pin with a first end portion comprising a brake receiving cavity defining the piston coupler braking surface with the friction brake being inserted at least partially into the brake receiving cavity. The piston pin can comprise a second end portion that defines a cavity that is at least partially conical with the pivot member engager comprising an outwardly projecting portion of the second end portion. An internal cavity can be provided that interconnects the second end portion cavity and the brake receiving cavity. The internal cavity, the second end portion cavity and the brake receiving cavity can be shaped and dimensioned to achieve a homogenous bending line in response to the application of force by the piston to the piston pin and the counterforce applied by the connecting rod during operation of the engine. As yet another aspect of an embodiment, the friction brake can comprise a stop portion positioned to engage the piston coupler to limit the extent of pivoting of the piston coupler to within a predetermined limit.

The invention encompasses all novel and non-obvious assemblies, sub-assemblies and individual elements, as well as method acts, that are novel and non-obvious and that are disclosed herein. The embodiments described below to illustrate the invention are examples only as the invention is defined by the claims set forth below. In this disclosure, the term "coupled" and "coupling" encompasses both a direct connection of elements as well as the indirect connection of elements through one or more other elements. Also, the terms "a" and "an" encompass both the singular and the plural. For example, if an element or a element is referred to, this includes one or more of such elements. For example, if a plurality of specific elements of one type present, there is also an element of the type described. The invention is also not limited to a construction which contains all of the features described herein.

Adjustable compression ratio engines can be operated to improve the efficiency of the engine by varying the compression ratio appropriately.

DETAILED DESCRIPTION

Figure 1:
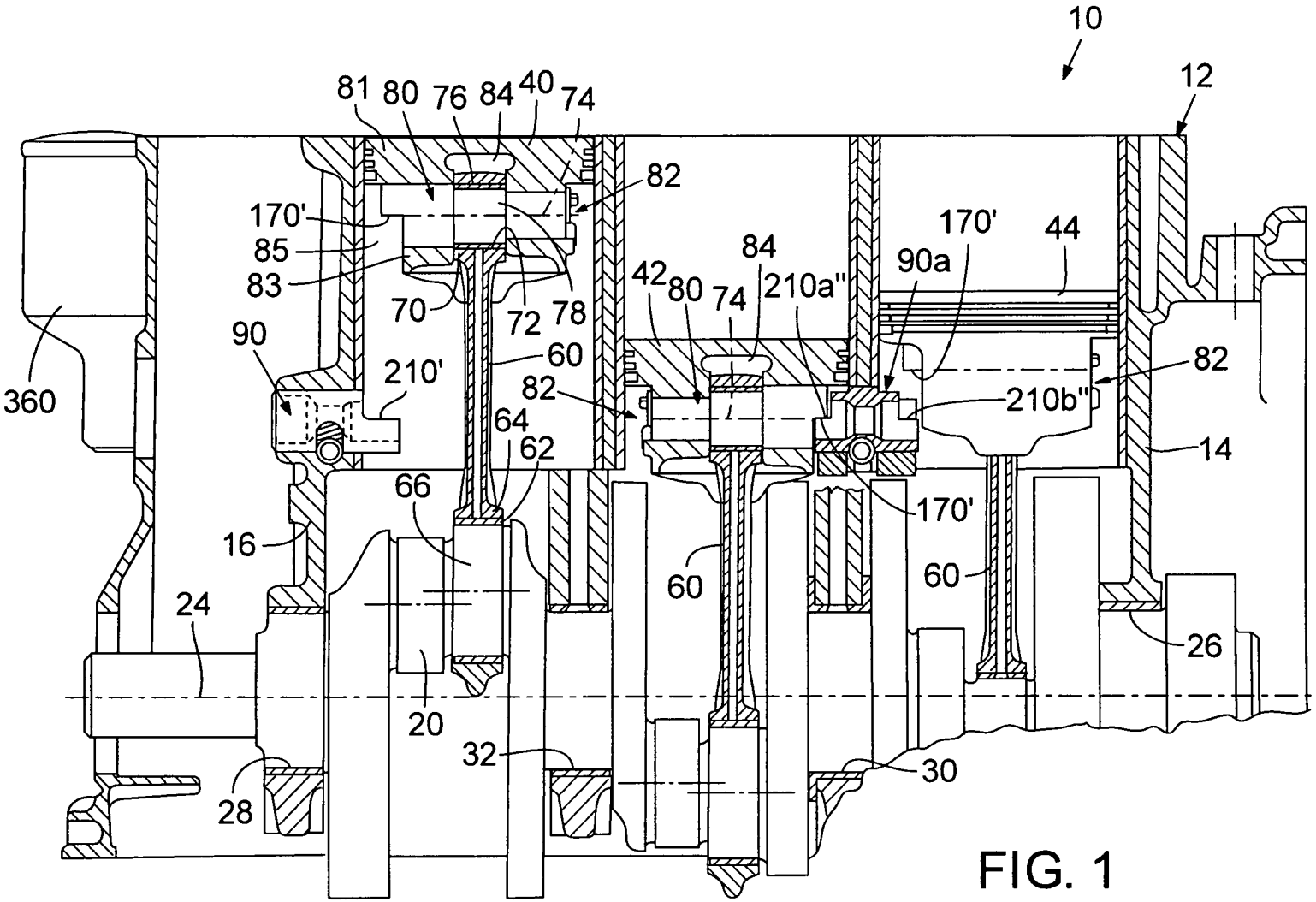
FIG. 1 is a vertical sectional view of an embodiment of an internal combustion engine with exemplary features allowing the variation of the compression ratio of pistons of the engine.

FIG. 1 illustrates a vertical sectional view through a portion of an internal combustion engine, in this case a six cylinder engine. Various dimensions of an exemplary engine are set forth in Table 1 below. It is to be understood that these dimensions are for example only and do not limit the scope of this disclosure.

TABLE 1

| Example | | |
|---|---|---|
| 6 Zyl | V 90° | Compression Chamber Volume 56.8-35.5 $cm^3$ |
| Bore | 94 mm | Eccentricity Piston Pin E1 = 1.8 mm |
| Stroke | 82 mm | Piston Pin turning angle max 110° |
| Displacement | 3408 $cm^3$ | Piston movement max 3 mm |
| Compression Ration | 10-16 | Eccentricity Piston centerline/ Pin centerline E2 = 1.4 mm |

The engine 10 of FIG. 1 comprises a portion of an engine block 12 having respective end walls 14, 16 that pivotally support a crank shaft 20 for rotation about an axis 24. Respective bearings 26, 28 (or bushings) pivotally couple the crank shaft to the respective housing walls. Additional support bearings or bushings 30, 32 couple the crank shaft to the engine housing at locations intermediate the ends of the crank shaft for further support.

For purposes of clarity only, portions of three pistons 40, 42 and 44 are shown in FIG. 1, the other three pistons of this illustrative engine are not shown. The technological developments disclosed herein are not limited to six cylinder engine applications as engines with any number of cylinders can utilize the technology.

In FIG. 1, the piston 40 is shown in a top dead center position, the piston 42 is shown in a bottom dead center position and the piston 44 is shown in an intermediate position. Since each of the pistons and the associated coupling elements can be identical, like numbers are assigned to like components for the various pistons and will be discussed in connection with piston 40. Thus, a piston or connecting rod 60 is coupled by bearings or bushings 62 at a lower end portion 64 of the connecting rod to a connecting rod mounting location 66 of the crank shaft 20. The upper end portion 70 of connecting rod 60 is provided with an opening 72 extending therethrough, the opening having a longitudinal axis 74 that is parallel to the longitudinal axis 24 of the crank shaft. In the example shown in FIG. 1, opening 72 is of a right cylindrical shape. A piston coupling bushing or bearing 76 can be positioned within opening 72. Bushing 76 has a centrally extending coupler receiving opening 78 extending therethrough. Opening 78 is of a right cylindrical configuration in this example and has a longitudinal axis concentric with the axis 74. A coupler such as a coupling or piston pin 80 extends through the opening 78 and couples the piston 40 to the connecting rod 60.

The piston 40 comprises a body having an upper cylindrical piston ring supporting portion 81 of a first diameter and a lower body portion sized to create a pivot member engager receiving space between the lower body portion 83. One end portion of the piston pin 40 extends outwardly from the lower body portion 83 and into a pivot member engager receiving space 85, said one end portion of the piston pin can comprise a pivot member engager (e.g., including engagement surface 170') as explained below.

Thus, in one embodiment, a pivot member engager comprises an outwardly projecting portion of a pivot coupler.

Coupler 80 in this configuration comprises an eccentric that can be pivoted to cause relative motion of the piston 40 relative to the connecting rod 60 to thereby vary the combustion chamber volume and thereby the compression ratio of the cylinder. Suitable couplers can assume shapes other than the shape of an elongated pin and comprise an eccentric operable to selectively shift the pivot axis of the connecting rod where it is coupled to the piston relative to the pivot axis about which the piston and pivot pin pivots. Exemplary constructions of an eccentric coupler 80 in the form of piston pins are described below. A coupler retaining mechanism, for example a friction brake 82, an example of which is explained below, can be used to retain the coupler 80 in, or resist the motion of the coupler 88 from, a desired position to which it has been pivoted. Given the small eccentricity that can be employed in certain embodiments of this technology, the piston coupler, such as the pin, can interfit tightly enough with the piston to resist motion from a desired position to which it has been pivoted until such time as the resistance is overcome by engaging a pivot member that has been shifted to a different position. A cavity 84 is provided in the head of piston 40 to accommodate the relative movement of the piston and connecting rod. A pivot mechanism is utilized to pivot the coupler 80 to a desired position of eccentricity to adjust the combustion ratio. An exemplary form of pivot member 90 is shown in FIG. 1 and is described in more detail below. A modified form of pivot member 90*a* is shown for selective coupling to the couplers for pistons 42 and 44 and is also described below. The pivot member 90*a* is an example of, a single or common pivot member for engaging the piston couplers 80 associated with first and second pistons (e.g., pistons 42, 44), the pivot member 90*a* comprising a first set of two pivot coupler engagement surfaces (e.g., 210*a*', 210*a*" of FIG. 9) for engaging the two pivot member engagement surfaces (e.g., 170', 170" of FIG. 5B) of the piston coupler 80 associated with the piston 42 and a second set of two pivot coupler engagement surfaces (e.g., 210*b*', 210*b*" of FIG. 9) for engaging the two pivot member engagement surfaces (e.g., 170', 170") of the piston coupler 80 associated with the piston 44.

Thus, in this example, there is at least one pivot member operable to pivot the pivot coupler of more than one piston.

In general, in the illustrated embodiment, as a piston approaches the bottom dead center position, the piston coupler 80 engages the pivot member 90 and, if the pivot member 90 has been pivoted to adjust the eccentricity of the associated coupler, the coupler engages the pivot member and is pivoted to the desired eccentricity position. During pivoting of coupler 80, the friction applied by friction brake 82, if included, is overcome to allow such pivoting. Following pivoting, the friction brake 82 retains the coupler 80 in position relative the connecting rod 60 until further adjustment of the pivot member to adjust the eccentricity position. If during a stroke the coupler 80 happens to pivot slightly in an undesired manner, upon return to the bottom dead center position, the coupler 80 is again adjusted to the desired position of eccentricity by engagement of the pivot engager portion of the coupler with the pivot member 90. The pivot members 90, 90*a* can be pivoted together so that their positions are maintained at the same rotational position. As each cylinder reaches its bottom dead center position, the eccentricity of the cylinder is adjusted if the pivot member has been turned. For example, in FIG. 1, piston 42 is at the bottom dead center position with surface 170" of piston coupler 80 shown engaging a surface 210*a*" of pivot member 90*a*. If pivot member 90*a* has been turned to adjust the eccentricity of the associated coupler 80, upon such engagement of surfaces 210*a*" and 170", the coupler 80 for piston 42 turns to adjust the relative position of piston 42 to its associated connecting rod 60. Similarly, as each of the other pistons 40, 44 reach their bottom dead center positions, they would likewise be adjusted to the desired compression ratio by pivoting their associated couplers 80.

Thus, an exemplary internal combustion engine comprises a rotatable crank shaft 24; at least one piston cylinder (e.g., in one example, six cylinders including cylinders receiving pistons 40, 42 and 44) with each piston being slidably received by its associated cylinder so as to reciprocate between top dead center and bottom dead center positions within the receiving cylinder. The piston comprises a first piston coupler portion receiving bore defining a first axis (e.g., axis 74 explained below) (see e.g., FIG. 7). The connecting rod 60 comprises a first crank coupling end portion 64 pivotally coupled to the crank shaft such that rotation of the crank shaft causes the connecting rod to reciprocate. The connecting rod 60 also comprises a second piston coupling end portion 70 comprising a second piston coupler receiving bore defining a second axis 160. A piston coupler (e.g., a piston pin 80) comprises a piston coupler portion pivotally received by the piston coupler receiving bore (e.g., the ends of piston pin 80 can comprise the piston coupler portion) so as to be pivotable about the first axis. The piston coupler comprises a connecting rod coupler portion (e.g. 78) pivotally received by the second piston coupler receiving bore to couple the connecting rod 60 to the piston (e.g., 40). One of the piston coupler portion and connecting rod coupler portion comprises an eccentric portion such that reciprocation of the connecting rod causes the piston to reciprocate between the top dead center and bottom dead center positions. Also, pivoting of the piston coupler about the first axis from a first coupler position to a second coupler position pivots the eccentric portion from a first eccentric position to a second eccentric position and shifts the second axis relative to the first axis to thereby vary the compression ratio of the associated cylinder. For purposes of an example, the portion 78 of pin 80C an be considered an eccentric portion. Alternatively, the piston coupler portion can be the eccentric portion. The piston coupler also comprises a pivot member engager that can comprise an end portion of a piston pin (e.g., surfaces 170', 170") and a pivot member (e.g., 90, 90*a*) comprising a pivot coupler engager (e.g., surfaces 210', 210"; 210*a*', 210*a*"; 210*b*', 210*b*") movable from a first pivot coupler engager position to a second pivot coupler engager position and positioned to engage the pivot member engager to pivot the piston coupler from the first coupler position to the second coupler position as the piston approaches the bottom dead center position and in response to such movement of the pivot coupler engager from the first pivot coupler engager position to the second pivot coupler engager position. The pivot coupler engager is also operable in one embodiment to disengage the pivot member engager as the piston travels away from the bottom dead center position.

The pivot member can be pivotable about a pivot member axis. In such a case, the pivot member can be pivotable about the pivot member axis from a first pivot member position to a second pivot member position to pivot the pivot coupler engager from the first pivot couple engager position to the second pivot coupler engager position. The piston coupler is pivoted from a first coupler position to a second coupler position as the piston approaches the bottom dead center position in response to the pivoting of the pivot coupler engager from the first pivot coupler engager position to the second pivot coupler engager position.

The pivot member engager can comprise at least one pivot member engagement surface (e.g., surface 170') and the pivot coupler engager can comprise at least one pivot coupler engagement surface (e.g. surface 210'). In this example, the at least one pivot coupler engagement surface can be pivoted from a first position to a second position in response to pivoting of the pivot member from the first pivot member position to the second pivot member position. The at least one pivot member engagement surface and at least one pivot coupler engagement surface are desirably positioned to engage one another as the piston approaches the bottom dead center position to pivot the piston coupler from the first coupler position to the second coupler position in response to the pivoting of the at least one pivot coupler engagement surface from the pivot coupler engager first position to the pivot coupler engager second position. The at least one pivot coupler engagement surface and the at least one pivot member engagement surface can each be a flat surface and such surfaces can be planar. In a specific embodiment, there are two of said pivot member engagement surfaces (e.g., 170', 170") positioned on opposite sides of the first axis. In an alternative embodiment, there can be a first set of two pivot coupler engagement surfaces on opposite sides of the pivot member axis (see surfaces 210', 210" of pivot member 90 and either surfaces 210*a*', 210*a*" or 210*b*', 210*b*" of pivot member 90*a*). In a specific form, the pivot member engager comprises downwardly facing first and second pivot member engagement surfaces of one end portion of a piston pin.

In the example of FIG. 1, the couplers 80 can, for example, have an eccentricity of 1.8 mm. In addition, the turning angle of the pivot member 90, 90*a* can be limited to a predetermined amount or extent. In a specific example, the turning angle can be limited to 110 degrees to thereby provide a maximum 3 mm piston movement. With the exemplary dimensions shown in Table 1, a variable combustion chamber volume is provided and a variable combustion ratio of from 10-16 results. These dimensions can be varied.

Figure 2:
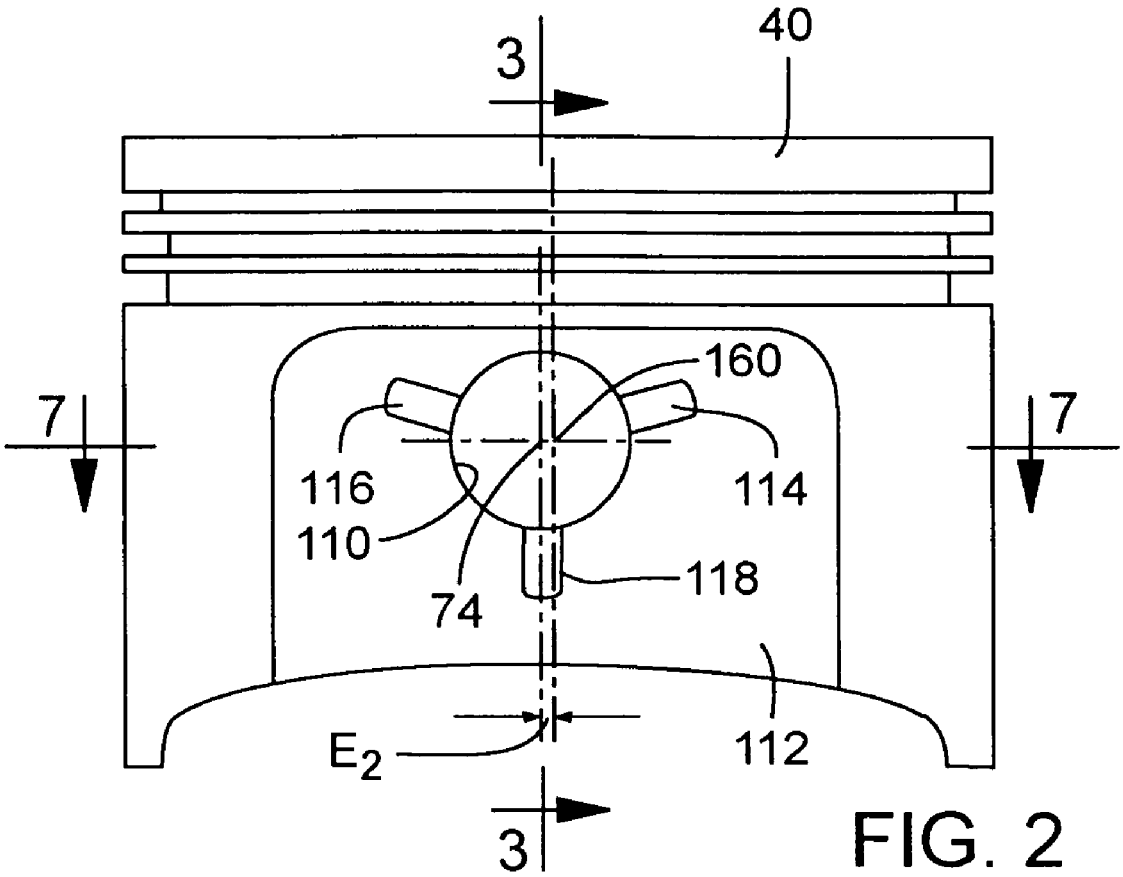
FIG. 2 is a side elevational view of an exemplary piston that can be included in the embodiment of FIG. 1.

FIG. 2 illustrates the piston 40 without the coupler 80 and without the connecting rod 60 coupled thereto. The piston 40 comprises a first bore section 110 of circular cross-section and having a longitudinal axis aligned with the longitudinal axis 74 in this example. Friction brake engagers are provided adjacent to the bore 110. These engagers can take numerous forms and are designed to engage a friction brake in the illustrated example to prevent rotation of the friction brake relative to the piston. Although recesses and other interfitting arrangements can be used, in FIG. 2 a plurality of projections, in this case radially extending projections 114, 116 and 118 are provided. These projections extend in an outward direction from the edge of bore 110 at locations spaced 120 degrees about the center of the bore 110. These projections extend outwardly away from a surface 112 of the piston.

Figure 3:
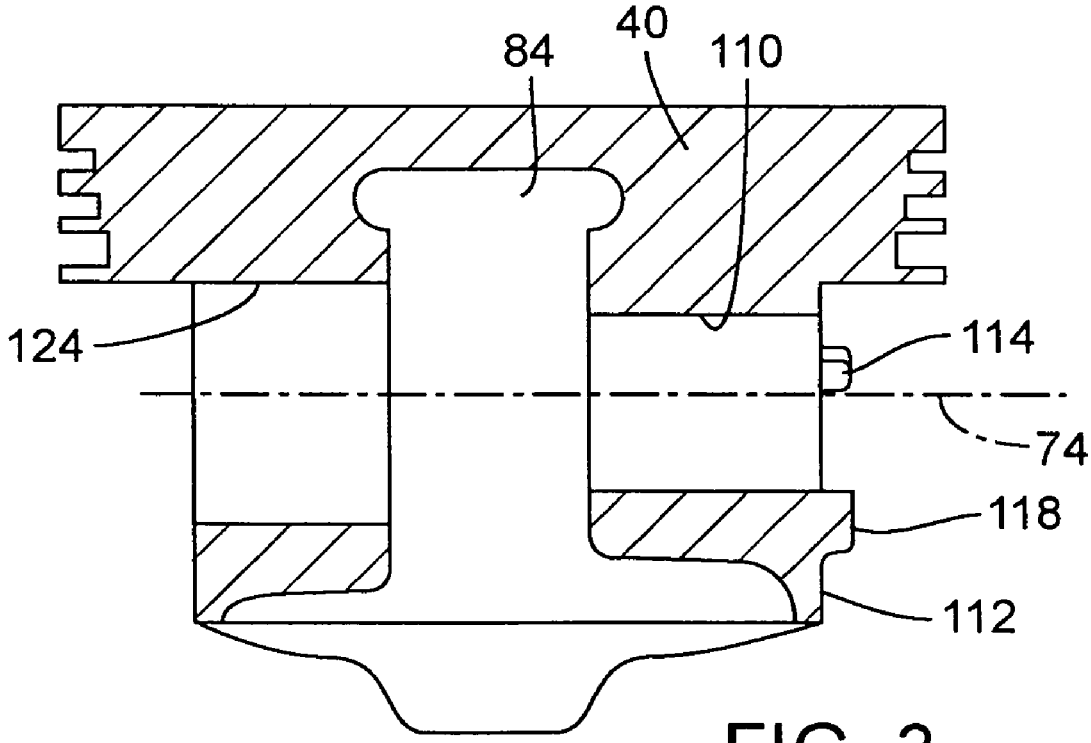
FIG. 3 is a vertical sectional view of the piston of FIG. 2 taken along line 3-3 of FIG. 2.

In FIG. 3, a vertical sectional view through piston 40 of FIG. 2, the bore 110 is shown along with the projections 114 and 118. A second bore 124, having a longitudinal axis corresponding to the axis 74 in this example, is also shown. The bores 110 and 124 are co-axial and are of right cylindrical shape.

Figure 4:
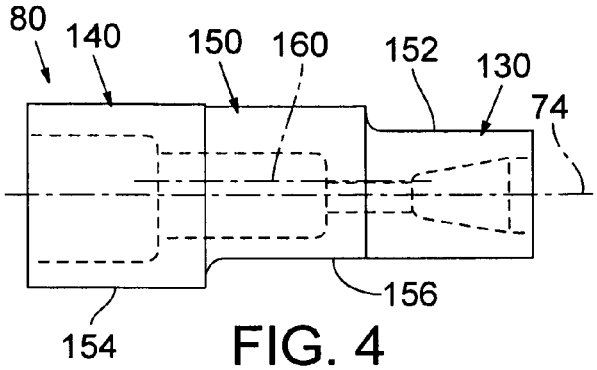
FIG. 4 is a top view of a piston coupler in the form of a piston pin in accordance with an embodiment thereof.
Figure 4A:
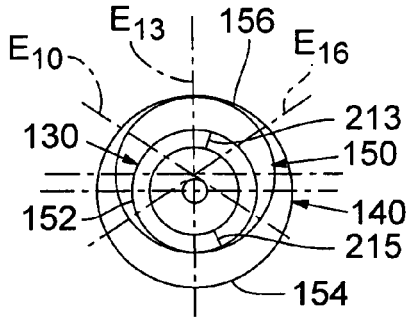
FIG. 4A is an end view of the piston pin of FIG. 4 looking toward the right end of the FIG. 4 piston pin.

FIGS. 4, 4B, 5, 5A and 5B illustrate an exemplary eccentric piston coupler 80 in the form of a piston pin for coupling the piston 40 to the associated connecting rod 60. Coupler 80 comprises a first end portion 130, a second end portion 140 and a central section 150 intermediate the first and second end portions 130, 140. End portion 130 comprises an exterior right cylindrical surface 152. End section 140 comprises a right cylindrical surface 154. In addition, the central portion 150 comprises a right cylindrical surface 156. The axis of cylindrical surface 156 is centered on the axis 160. In contrast, the surfaces 152,154 are eccentrically located relative to axis 160 as these surfaces have a longitudinal axis centered on an axis 74 with the spacing between axes 74 and 160 indicating the eccentric offset (see, e.g., offset $E_2$ in FIG. 2). FIG. 4*a* illustrates an end view of the coupler 80 of FIG. 4. Thus, at least one portion of the piston coupler of this example can comprise an eccentric portion that is eccentric relative to at least one other portion of the piston coupler.

Figure 4B:
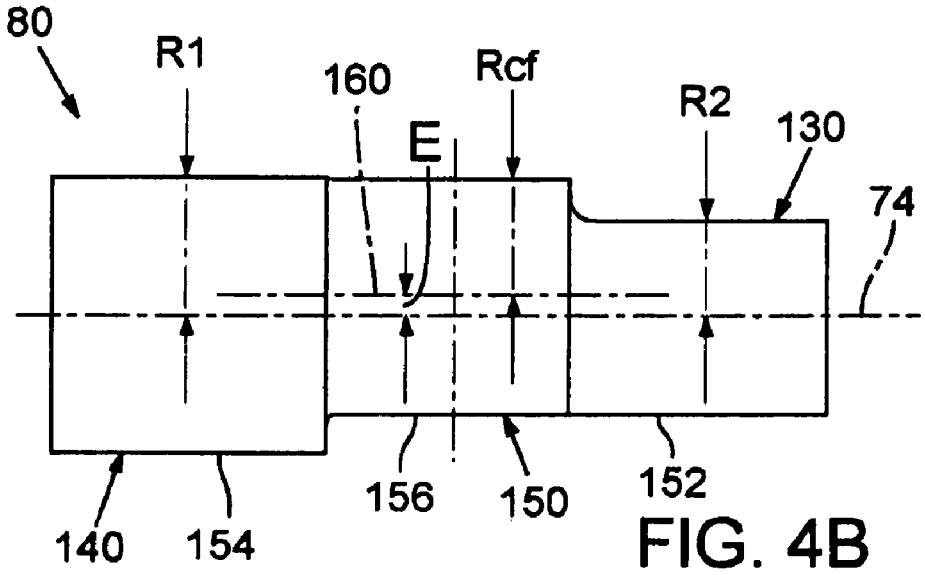
FIG. 4B depicts the piston pin of FIG. 4 with exemplary radiuses indicated for three different sections of the pin of the embodiment of FIG. 4 and with an eccentricity E also indicated in FIG. 4B.
Figure 7A:
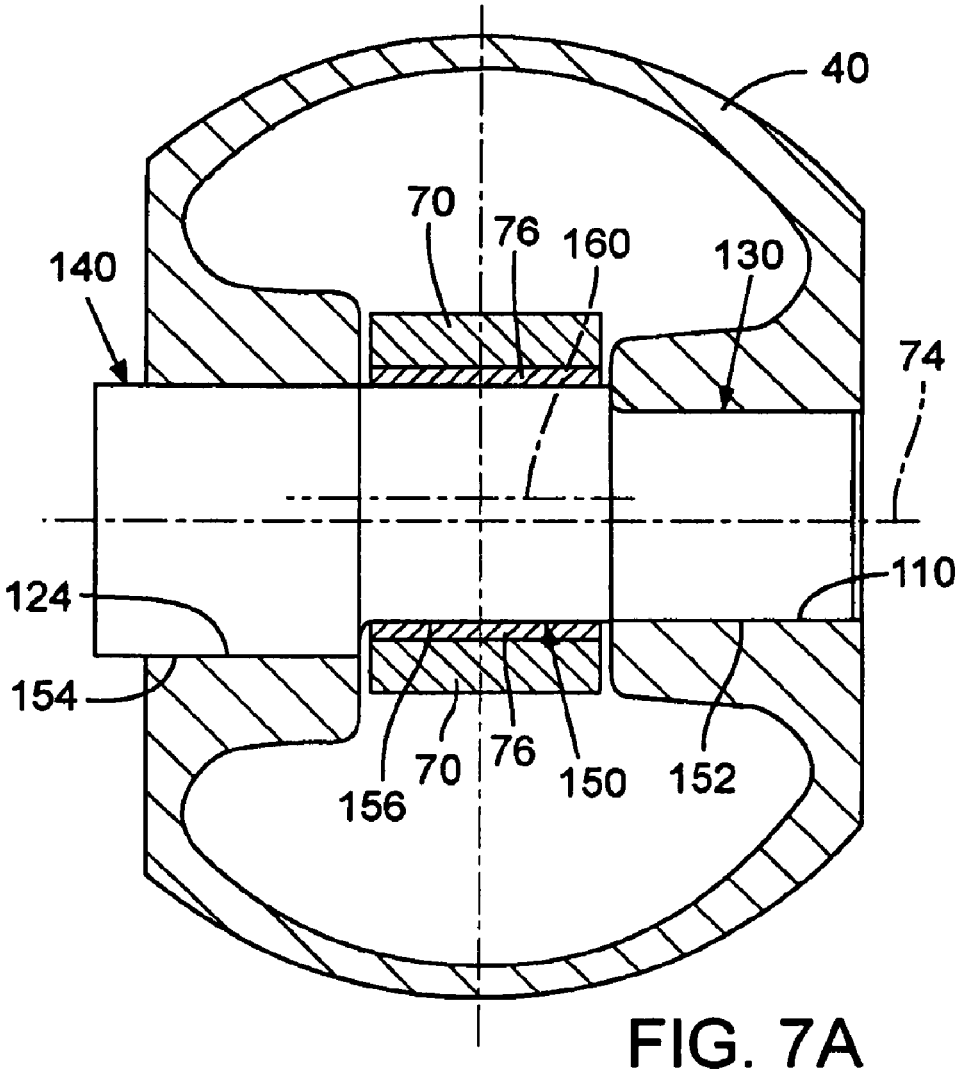
FIG. 7A is similar to FIG. 7 without the piston pin being sectionalized and adding a portion of a connecting rod and connecting rod supporting bushing to FIG. 7A.

With reference to FIG. 4B, the maximum eccentricity of this form of coupler can be defined as E and corresponds to the maximum offset between the first and second axes 74, 160 arising from pivoting the eccentric portion 150. The piston coupler 80 comprises a piston pin comprising first and third portions 130, 140 and a second portion 150 intermediate the first and third portions, the first and third portions have longitudinal centerlines that are aligned with the first axis 160. In addition, the second portion 150 comprises the eccentric portion and has a longitudinal center line that is aligned with the second axis 160. In this example, the first, second and third portions comprise right cylindrical surfaces 152, 154. Also, the second portion comprises a right cylindrical surface 156 of a first radius defined as $R_{CR}$, one of the first and third portions (e.g., portion 140) has a right cylindrical surface of a radius $R_1$, wherein $R_1 \geqq (R_{CR}+E)$, and the other of the first and third portions (e.g., portion 130) has a right cylindrical surface of a radius $R_2$, wherein $R_2 \leqq (R_{CR}-E)$.

Figure 5B:
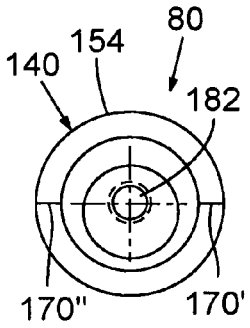
FIG. 5B is an end view looking forward the left hand end of the piston pin of FIG. 5 taken as if the piston pin of FIG. 5 has not been sectioned.
Figure 5:
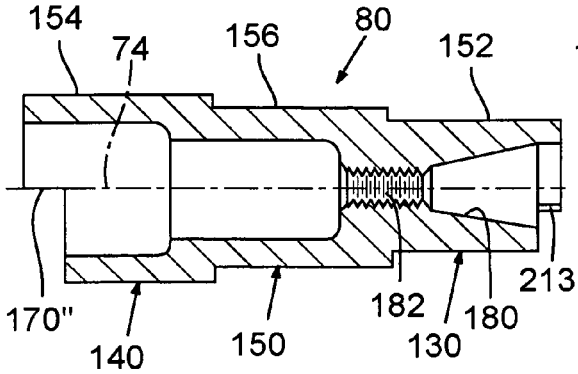
FIG. 5 is a horizontal sectional view through the piston pin of FIG. 4.
Figure 5A:
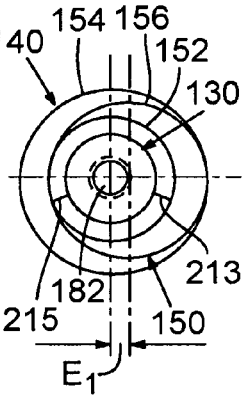
FIG. 5A is an end view looking toward the right end of the piston pin in FIG. 5 taken as if the piston pin of FIG. 5 had not been sectioned.
Figure 5C:
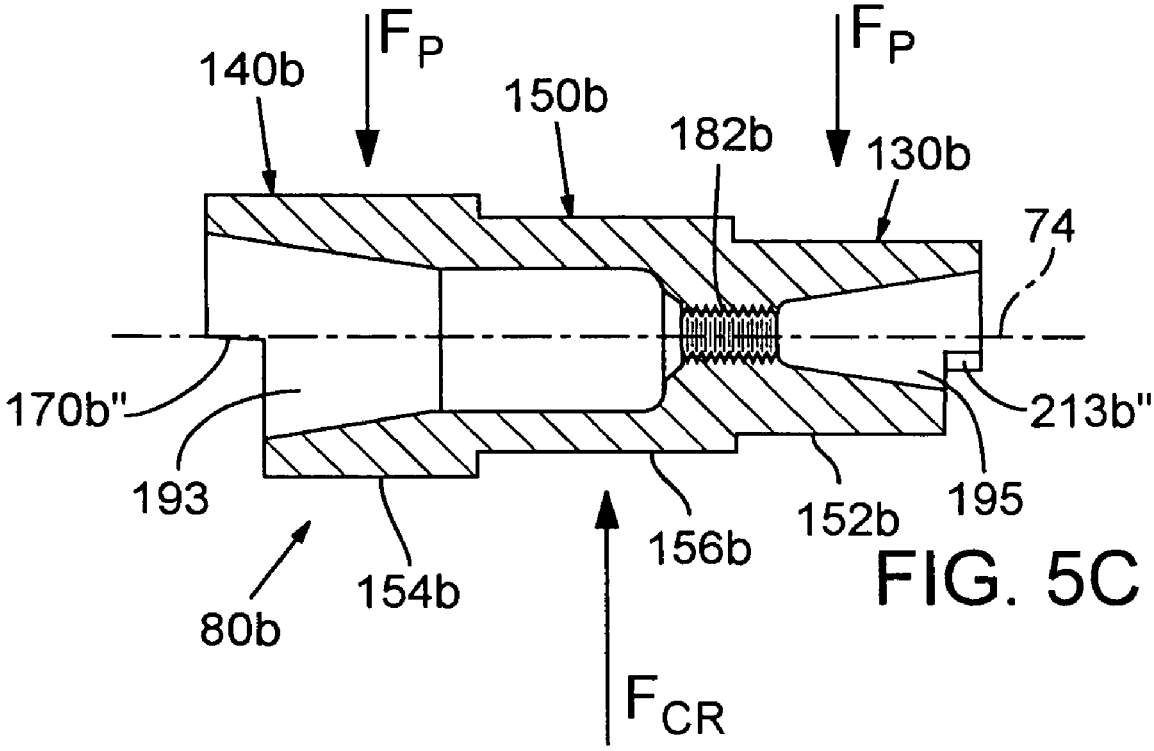
FIG. 5C is a sectional view through yet another form of pivot pin similar to the sectional view of FIG. 5, with FIG. 5C illustrating one internal cavity within the piston pin of a different configuration than the corresponding cavity shown in FIG. 5.

In an embodiment shown in FIG. 5C, a second end portion 140*b* of the piston pin defines a second cavity 193 that is at least partially conical. In this example, a pivot member engager comprises (e.g., including surface 170*b*") an outwardly projecting portion of the second end portion of the piston pin. Also, a first end portion 130*b* of this form of pivot pin also defines a first cavity 195 that is at least partially conical with a surface 213*b*" operable as explained below in connection with surface 213 of FIG. 7.

Figure 5D:
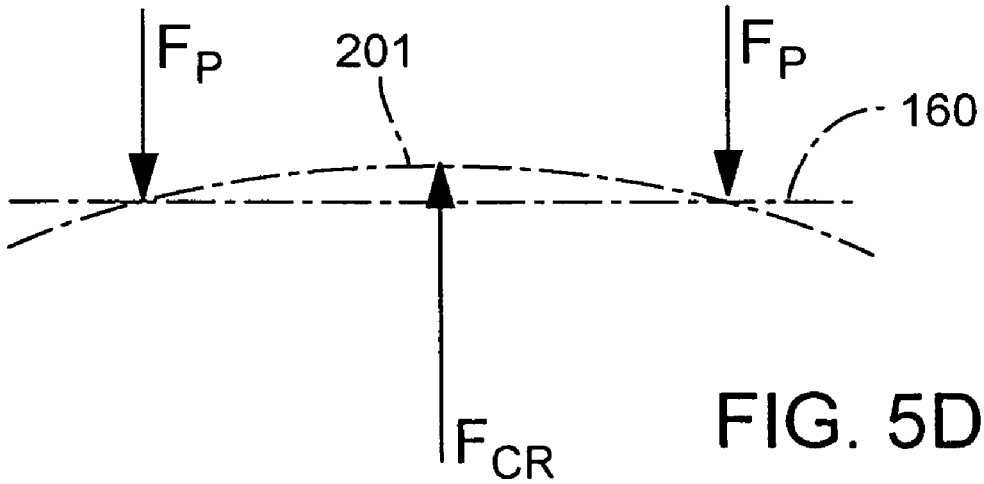
FIG. 5D illustrates an homogeneous bending line achievable using the design for a piston pin of FIG. 5C in response to the application of force by the piston to the piston pin (force lines Fp, Fp) and the counterforce (indicated by $F_{cr}$) applied by the connecting rod during operation of the engine.

An internal cavity 182*b* interconnects the first and second cavities 193, 195. The internal cavity and the first and second cavities can be shaped and dimensioned to achieve a homogenous bending line 201 (FIG. 5D) in response to the application of force by the piston to the piston pin (forces $F_p$, $F_p$ applied to end portions of the piston pin) and the counterforce applied by the connecting rod during operation of the engine.

Figure 7:
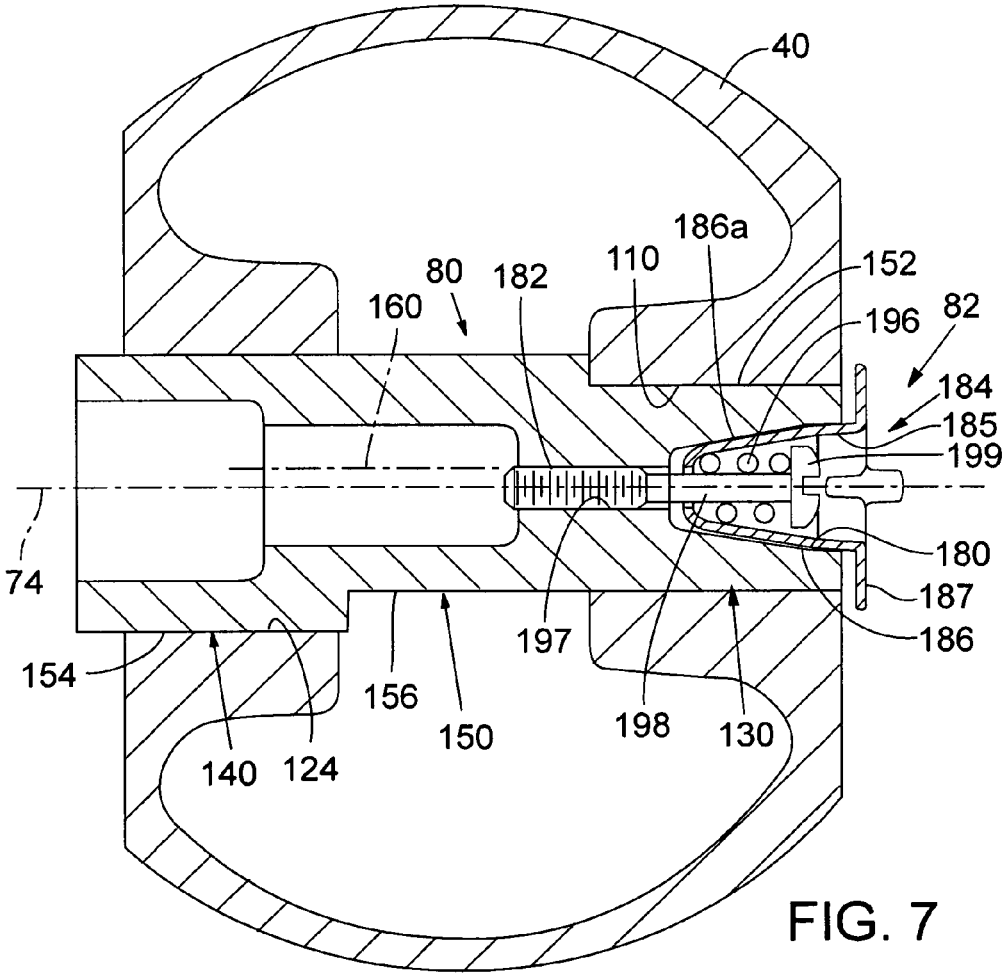
FIG. 7 is a horizontal sectional view looking downwardly from the top of a piston of the form shown in FIG. 2, taken along line 7-7 of FIG. 2, and with the piston pin of FIG. 4 assembled with the piston.

The piston coupler can comprise a first end portion 130 (FIG. 7) comprising a piston coupler braking surface and a second end portion 140, the pivot member engager can comprise an outwardly projecting portion of the second end portion. FIG. 7 illustrates the coupler 80 installed in place. With this exemplary construction, turning of the coupler 80 shifts the piston relative to the piston rod to thereby vary the combustion ratio.

Figure 4C:
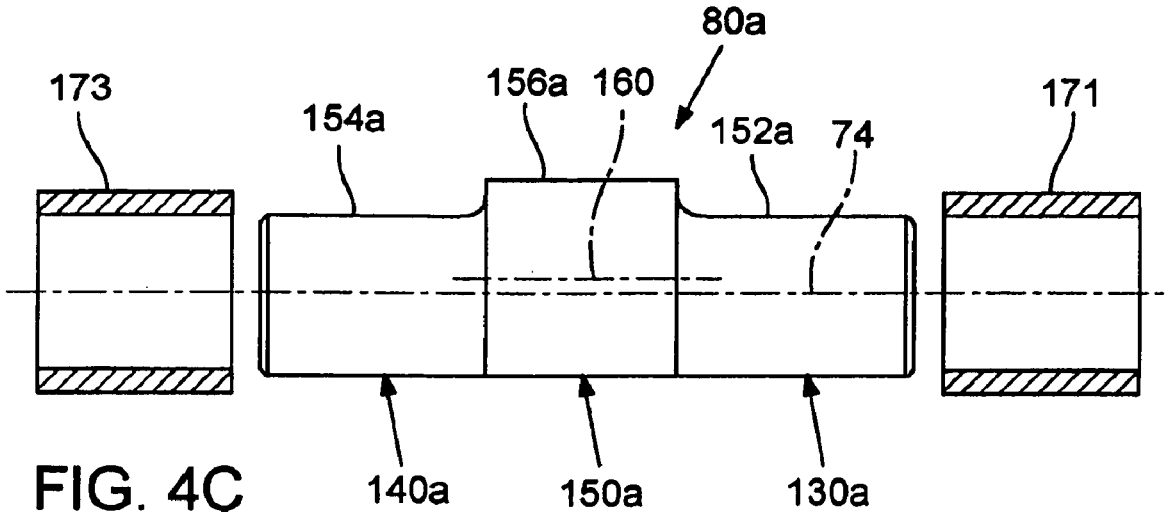
FIG. 4C illustrates yet another embodiment of an exemplary piston pin.
Figure 7B:
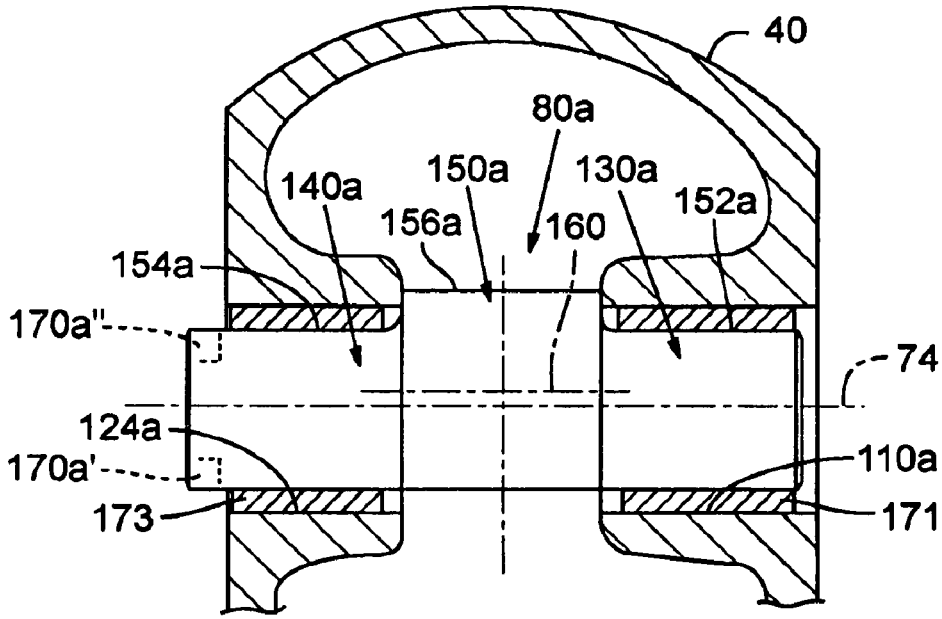
FIG. 7B is a sectional view similar to FIG. 7 including an un-sectioned view of a pivot pin of the form shown in FIG. 4C, it being understood that the pin of FIG. 4C can include cavities such as of the form shown in FIG. 4, FIG. 7 and FIG. 5C.

FIGS. 4C and 7B illustrate an alternative form of coupler 80*a*. In this form, first and third portions 130*a*, 140*a* have respective first and third diameters that are equal. Also, portion 150*a* has a second diameter that is greater than the first and third diameters. In this example, the piston coupler receiving bore comprises right cylindrical first and second piston bore portions 110*a*, 124*a* having a diameter that is greater than the second diameter such that the piston pin is insertable in one direction through one of the first and second piston bore portions and the connecting rod bore. A first bushing 171 is mounted to the first piston pin portion 130*a* and positioned within the first piston bore portion 110*a* and second bushing 173 is mounted to the third piston pin portion 140*a* and is positioned within the second piston bore portion 124*a*. One or both of the bushings 171, 173 are desirably mounted in place after the piston pin has been inserted into the piston and through the connecting rod. The first and second bushings 171, 173 restrict the piston pin against motion along the axis 74.

With reference to FIG. 5B, an exemplary pivot member engager can comprise at least one pivot member engagement surface (e.g., two surfaces 170' and 170"). The pivot coupler engager can comprise at least one pivot coupler engagement surface (see FIG. 9). The at least one pivot coupler engagement surface can be pivoted from a first position to a second position in response to pivoting of the pivot member from the first pivot member position to the second pivot member position. The at least one pivot member engagement surface and at least one pivot coupler engagement surface are desirably positioned to engage one another as the piston approaches the bottom dead center position to pivot the piston coupler from the first coupler position to the second coupler position in response to the pivoting of the at least one pivot coupler engagement surface from the pivot coupler engager first position to the pivot coupler engager second position.

Again, FIG. 5 illustrates a vertical sectional view through the exemplary coupler 80. FIGS. 5*a* and 5*b* are respective end views of the coupler. FIG. 5 also illustrates a pivot member engaging element, in this case a surface 170" positioned to engage the pivot member 90 to turn the coupler 80 to adjust the eccentricity of the coupler and thereby the compression ratio as explained below.

Figure 6:
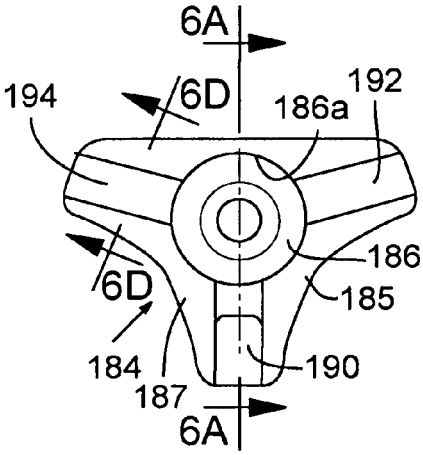
FIG. 6 illustrates a portion of an exemplary friction brake that can be used to resist pivoting motion of the piston pin of FIG. 5 relative to the piston after the piston pin has been pivoted to achieve a desired engine compression.
Figure 6B:
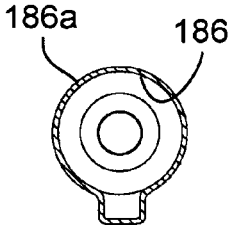
FIG. 6B is a vertical sectional view taken along line 6B-6B of FIG. 6A.
Figure 6A:
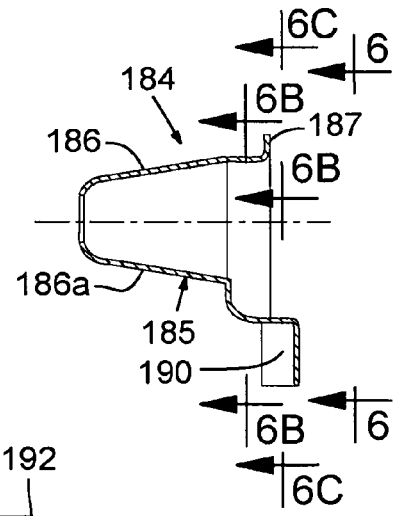
FIG. 6A is a vertical sectional view taken along line 6A-6A of FIG. 6.
Figure 6D:
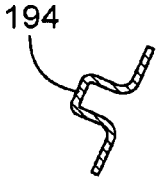
FIG. 6D is a vertical sectional view taken along line 6D-6D of FIG. 6C.
Figure 6C:
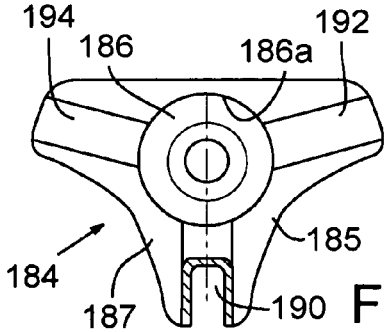
FIG. 6C is a vertical sectional view taken along line 6C-6C of FIG. 6A.

The internal combustion engine can also comprise a piston coupler retainer coupled to the piston coupler to apply a retention force to resist pivoting of the piston coupler. The piston coupler retainer can also limit the pivoting of the pivot coupler about the first axis (e.g., axis 74) to be within a predetermined limit. One specific example of a mechanism for retaining the piston coupler in a location to which it has been pivoted or turned, comprises a friction brake. The illustrated coupler comprises a brake engaging surface, such as a partially conical or frusto conical recess 180 extending inwardly into the end portion 130 of coupler 80. An internal bore 182 is provided at the base of recess 180. An exemplary friction brake 184 is shown in FIGS. 6 and 6*a*. The illustrated friction brake comprises a body 185 with a generally conical braking component 186 having an external braking surface 186*a* shaped to engage the braking surface 180 of the coupler 80. The body 185 can comprise a generally triangular base portion 187 from which the braking portion 186 projects. The base 185 can also be provided with interfitting members that mate with or interfit with corresponding interfitting members of the piston. Thus, for example, the base can comprise plural indentations or recesses 190, 192, 194 for engaging the respective projections 118, 114 and 116 of the piston (see FIG. 2). When engaged in this manner, relative rotation between the brake 184 and the piston 42 is prevented. As can be seen in FIG. 7, a biasing spring 196 can be positioned within the conical portion 186 of the break 184. A braking force adjustment screw 198 having a head 197 threadedly received and captured in a threaded bore 182 of coupler 80 is provided. A nut 199 coupled to screw 198 can be rotated to adjust the braking force by changing the axial position of the screw in bore 182 to thereby change the compression of the spring 196. The nut 199 can be fastened to or otherwise mounted so as to be retained on the screw so as not to be dislodged during operation of the engine. Surfaces 213, 215 (FIG. 4A) of the piston pin cooperate with the friction brake to limit the extent of pivoting of the piston pin to within a predetermined angular limit, such as 110 degrees. Other mechanisms can be used to limit such pivoting.

Thus, in this example, each of the piston coupler braking surface and friction brake braking surface is at least partially conical. The piston coupler, in this example, comprises a piston pin with first and second end portions, the first end portion comprising a brake receiving first cavity defining the piston coupler braking surface. Also, a friction brake being inserted at least partially into the brake receiving cavity in this example.

Figure 8A:
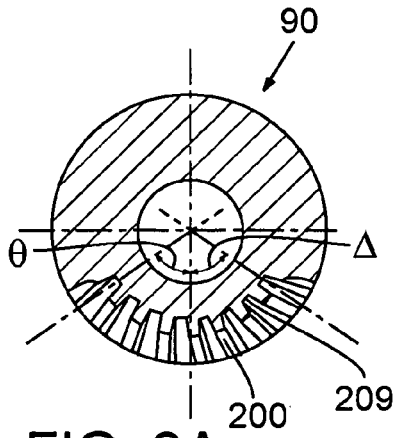
FIG. 8A is a sectional view taken along lines 8A-8A of FIG. 8, but as if the pivot member of FIG. 8 had not been sectioned.
Figure 8:
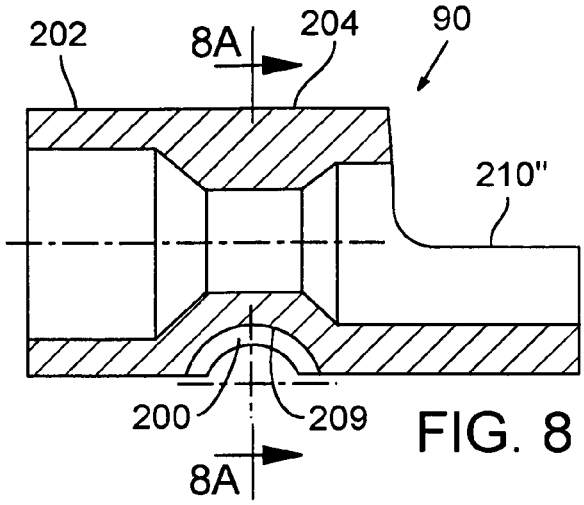
FIG. 8 illustrates a vertical sectional view of one exemplary form of a pivot member configured to engage and pivot a pivot coupler, such as a piston pin, to vary the compression ratio of a piston cylinder.
Figure 13:
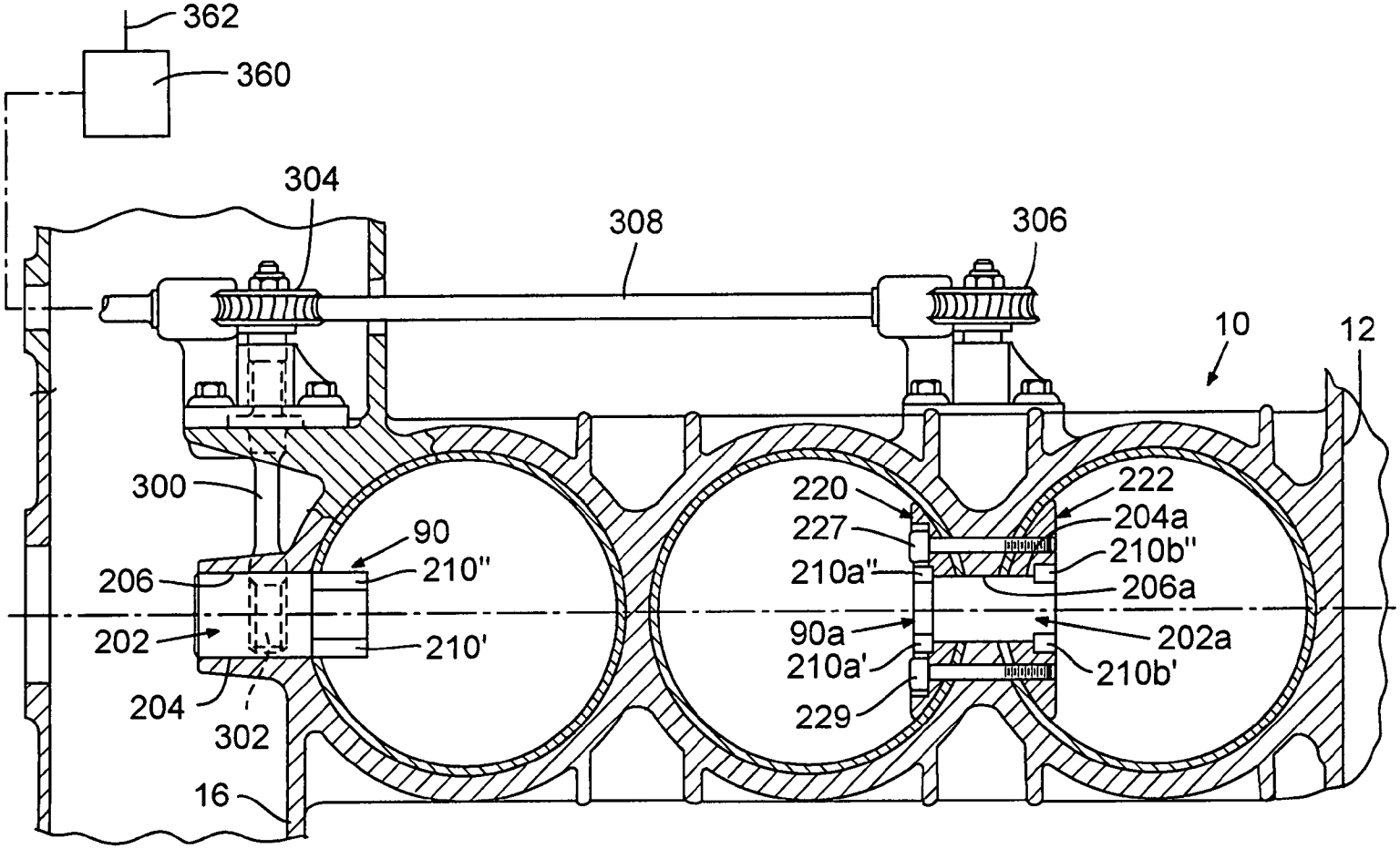
FIG. 13 is a vertical cross-sectional view through a portion of an internal combustion engine of the type shown in FIG. 1, illustrating exemplary pivot members having end portions projecting into lower regions of respective cylinder areas.

FIGS. 8 and 8*a* illustrate an exemplary pivot member 90. The illustrated pivot member comprises a body 202 having an outer surface 204 which can be of a right cylindrical shape for insertion into a bore 206 in the end wall 16 of the engine housing 12 (FIG. 13). A recess 209 can be provided in the body 202. In the FIGS. 8 and 8*a* form, recess 209 is an arcuate recess having a radius and centered about the axis 24. A worm gear 200 is positioned and captured or formed within recess 209. As can be seen in FIG. 8*a*, the illustrated recess 209 does not extend entirely around the circumference of the body 202. Instead, the recess 209 and worm gear is of a limited length, in this example, although this can be varied, the length is limited to "θ"+"Δ", such as 110 degrees (e.g., in the example where "θ" is equal to "Δ" and equal to 55 degrees, 55 degrees either side of vertical). This limits the extent to which the pivot member 90 can be turned during operation of the engine. The pivot member also comprises first and second eccentric coupler engaging surfaces 210', 210" (only one, namely 210", of which is shown in FIG. 8, and with both of these surfaces being shown in FIG. 13). The operation of these surfaces to engage and pivot the eccentric coupler will be understood from the description below.

In this example, the worm gear drivenly is coupled to the pivot member. A motor can be coupled to the worm gear and is operable to pivot the pivot member from plural first positions to plural second positions to adjust the compression ratio to a plurality of values. Also, as a specific example, the pivot member can define a recess extending in a direction perpendicular to the pivot member axis, the worm gear being positioned at least partially in the recess. The worm gear engages the pivot member to restrict movement of the pivot member in either direction along the pivot member axis. Also, as explained above, the worm gear can be configured to restrict pivoting of the pivot member to be within a predetermined limit. Thus, the predetermined limit can be, in one example, approximately one hundred and ten degrees. The center position of the limit can correspond to the pivot coupler being pivoted to a position that aligns the first axis 74 and the second axis 160.

Figure 9:
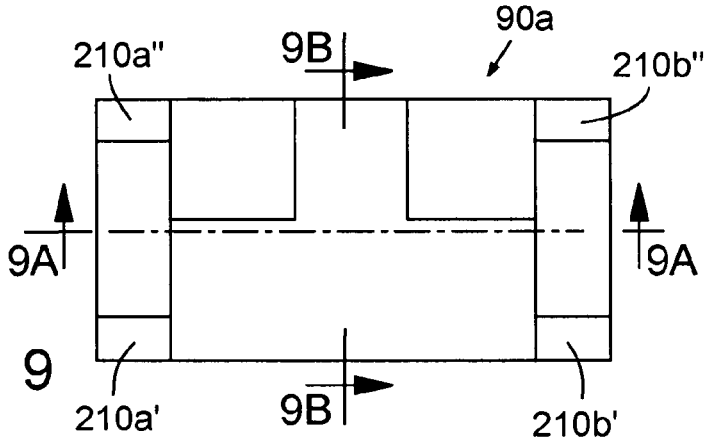
FIG. 9 is a top view of an exemplary form of pivot member that can be used to pivot piston pins of more than one piston to vary the compression ratio of the piston cylinders of such pistons.
Figure 9B:
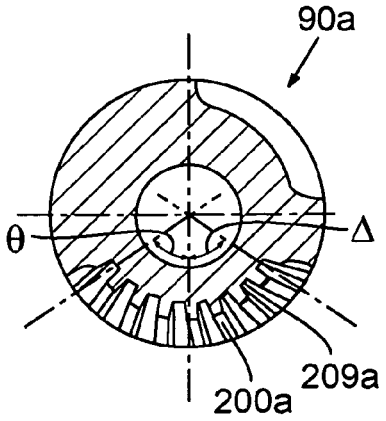
FIG. 9B is a vertical sectional view through the pivot member of FIG. 9, taken along 9B-9B of FIG. 9.
Figure 9A:
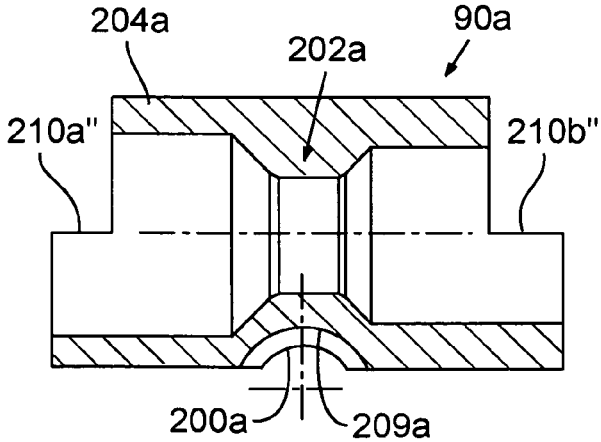
FIG. 9A is a vertical sectional view of the pivot member of FIG. 9, taken along line 9A-9A of FIG. 9.
Figure 10:
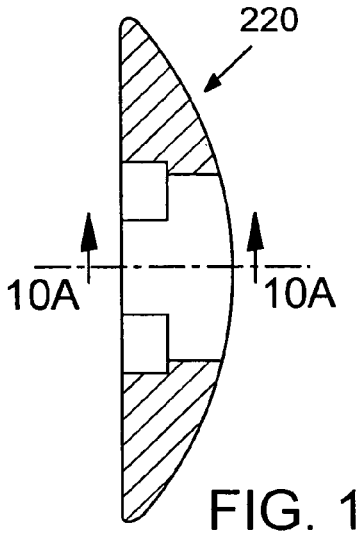
FIGS. 10 and 11 are horizontal sectional views of support brackets (shown installed in the internal combustion engine of FIG. 13) that can be used to support a pivot member, such as a pivot member of the form shown in FIG. 9 with FIG. 10 being taken along line 10-10 of an un-sectioned bracket of the form shown in FIG. 10A and FIG. 11 being taken along line 11-11 of an un-sectioned bracket of the form shown in FIG. 11A.
Figure 11:
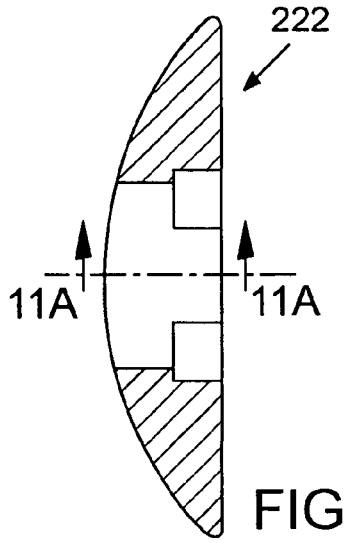
Figure 10A:
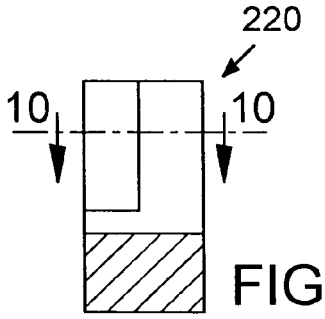
FIGS. 10A and 11A are vertical sectional views through un-sectioned brackets of the type shown in FIGS. 10 and 11, taken along line 10A-10A of FIG. 10 for FIG. 10A and along line 11A-11A of FIG. 11 for FIG. 11A.
Figure 11A:
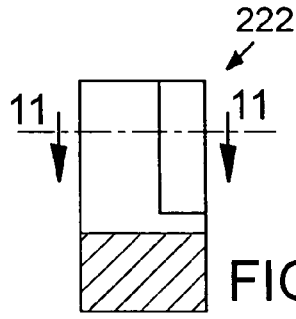
Figure 12A:
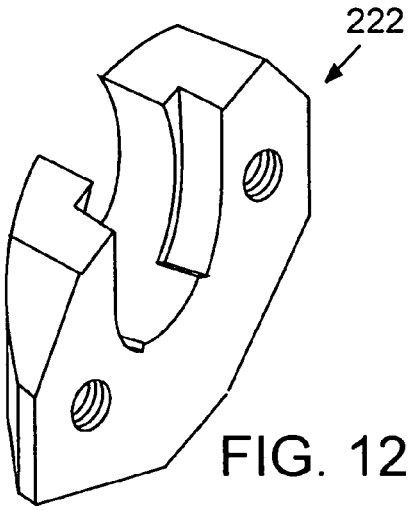
FIG. 12A is a perspective view of a bracket of the form shown in part in FIG. 11.
Figure 12:
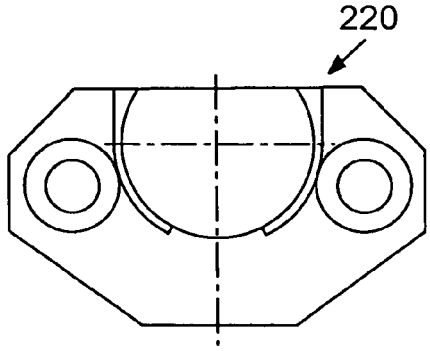
FIG. 12 is a side elevational view of an entire bracket of the form shown in part in FIG. 10 and of the type installed in the engine of FIG. 13.

FIGS. 9, 9A and 9B illustrate another exemplary form of pivot member 90*a*. Components of the FIG. 90*a* example of pivot member in common with those of pivot member 90 are assigned the same numbers as in FIGS. 8 and 8*a* with the letter "a" following the number. When mounted in place, the illustrated form of pivot member 90*a* provides two coupler engaging surfaces 210*a*', 210*a*" in position to engage the piston coupler 80 that couples piston 42 to its associated piston rod 60 and two coupler engaging surfaces 210*b*' and 210*b*" in position to engage the coupler 80 that couples piston 44 to its piston rod 60. These engaging surfaces are also shown in FIG. 13. Pivot member supports 220, 222 shown in FIGS. 10, 10*a*, 11, 11*a* and 12 can be mounted to engine block 12 as shown in FIG. 13 to support and retain the pivot member 90*a* in position. In this example, pivot member 90*a* comprises one form of a common pivot member comprising a first pivot member end portion extending into a first region defined by the first cylinder and a second pivot member end portion extending into a second region defined by the second cylinder. A first bracket can be coupled to the first cylinder in a position to pivotally support the first pivot member end portion. A second bracket can be coupled to the second cylinder in a position to pivotally support the second pivot member end portion. The first and second brackets can be fastened together (e.g., using bolts 227, 229) with a portion of the first cylinder and a portion of the second cylinder positioned between the first and second brackets. The first and second bracket can be shaped to provide clearance for the respective pivot member engagement surfaces and pivot coupler engagement surface to engage one another.

Figure 14:
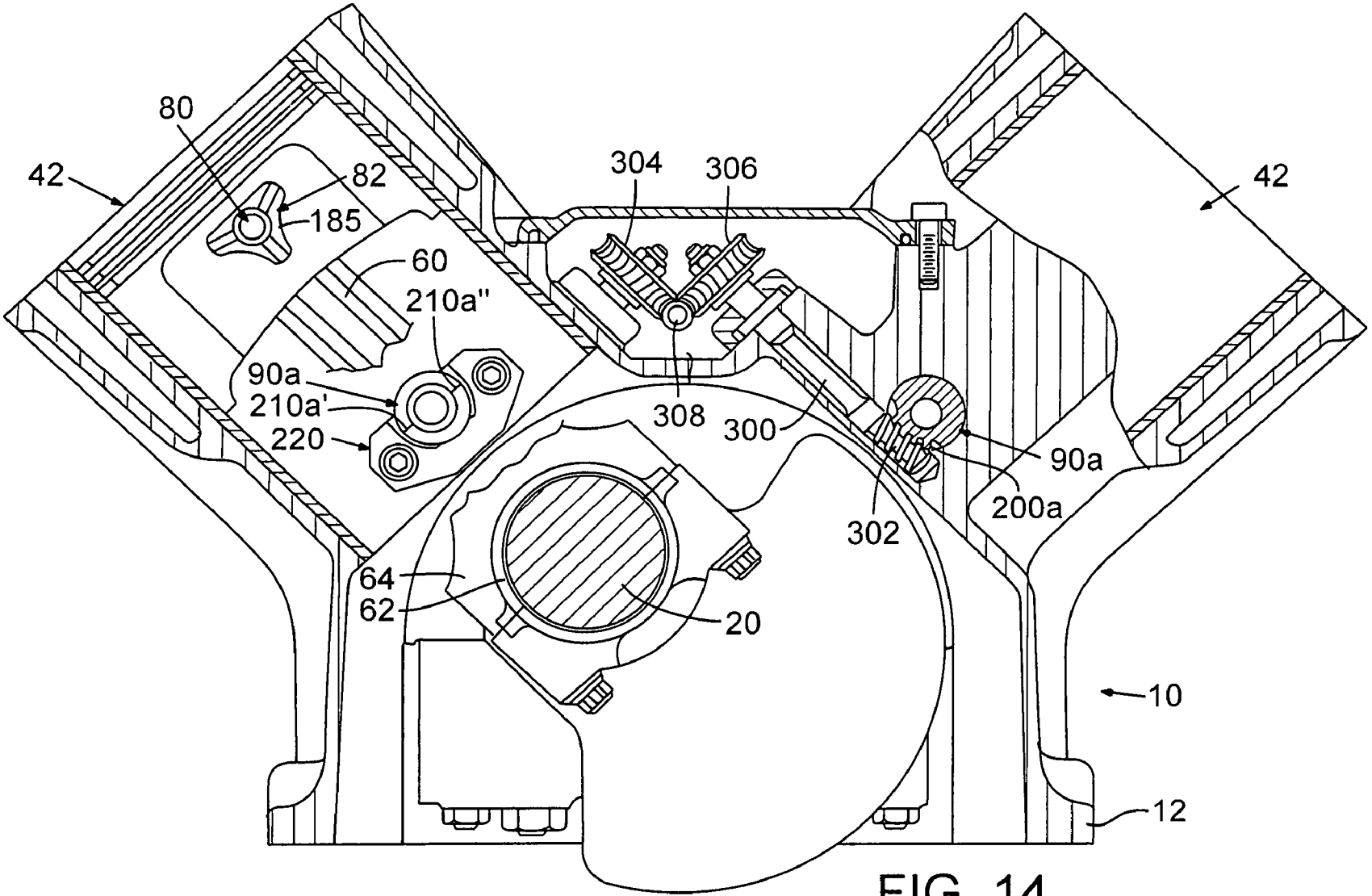
FIG. 14 is a transverse vertical sectional view of the internal combustion engine of FIG. 1.
Figure 14A:
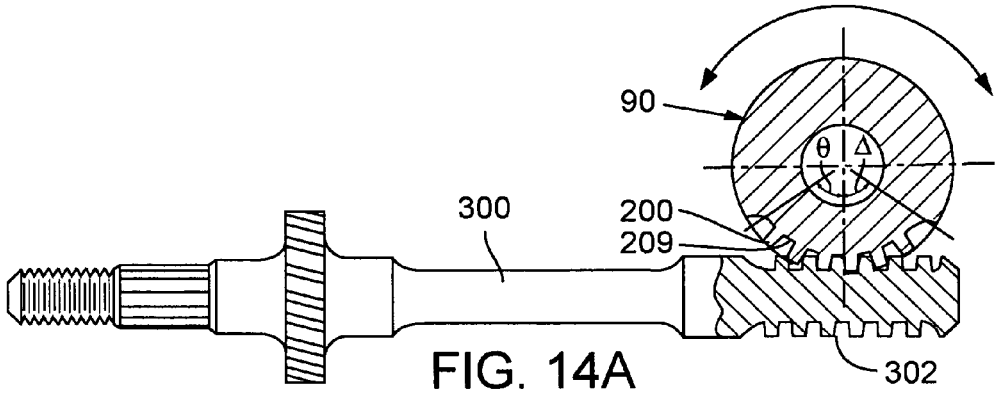
FIGS. 14A, 14B and 14C illustrate an exemplary pivot member drive mechanism, in this case a worm gear guide mechanism for pivoting exemplary pivot members.
Figure 14B:
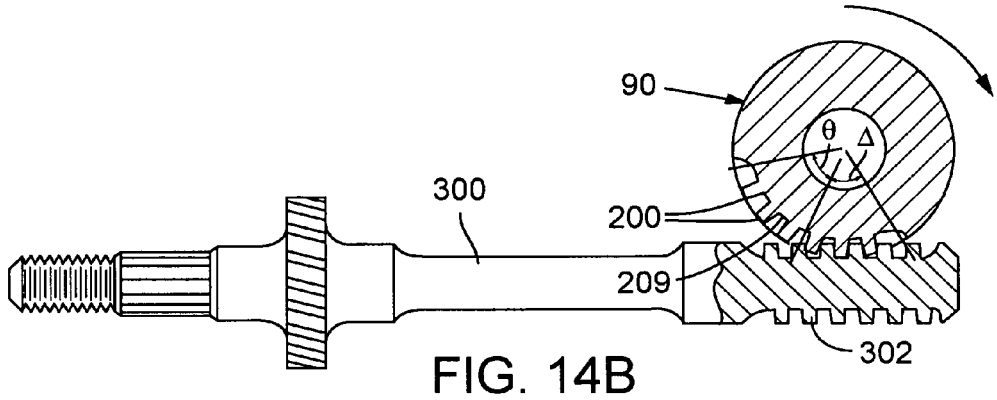
Figure 14C:
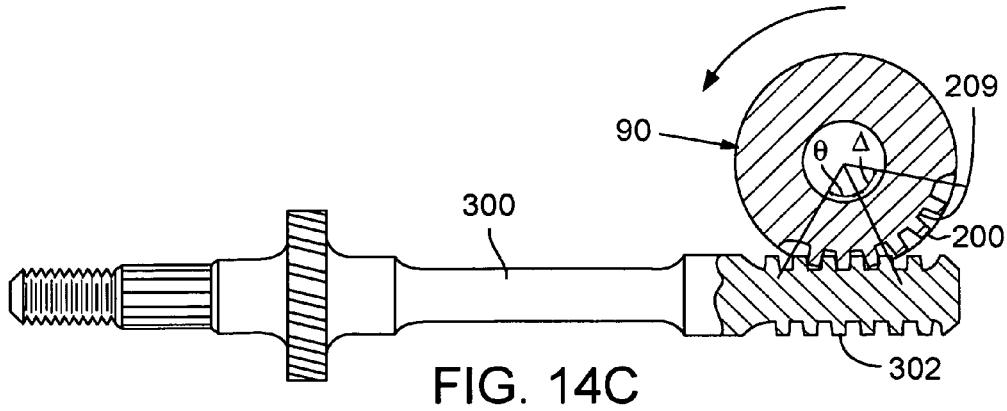

With reference to FIG. 13, a shaft 300 having a distal end portion with a worm gear drive portion 302 engages the worm gear 200 of pivot member 90 such that rotation of the shaft 300 in respective opposite directions pivots the pivot member 90 in respective opposite directions within the limits of the worm gear 200. A similar shaft (not shown) can be used to drive the worm gear 209*a* of pivot member 90*a*. These shafts 300 are respectfully driven by worm gears 304, 306 coupled thereto. A rotatable shaft 308 having worm gear drive elements coupled thereto and in engagement with worm gears 304, 306 is rotated in respective opposite directions to drive the worm gears 304, 306 and the associated shafts 300 and pivot members 90 and 90*a* in the desired direction for adjusting the position of the respective pivot members 90, 90*a* together. FIGS. 14A, 14B, and 14C illustrate exemplary positions of the pivot member driven by the associated worm gear. A motor 360 controlled by control signals via a connector 362 (or wireless coupling or other coupling) can be controlled to drive the shaft 308 and thereby the mechanism as explained above. Motor 360 can be any suitable motor, such as a stepper motor. Control signals for motor 360 can come from, for example, a microprocessor or electronic control module via an electrical signal carrying bus of a vehicle. The interaction of these components will be more apparent from FIG. 14 wherein corresponding elements are given corresponding numbers.

The operation of these exemplary components will also be better understood with reference to FIGS. 15A-15D.

Figure 15A:
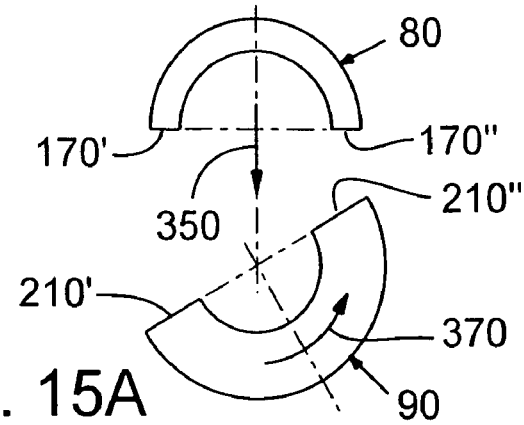
FIGS. 15A, 15B, 15C and 15D schematically illustrate pivoting of a pivot member engaging portion of a piston pin to shift the axis of the connecting rod to piston coupling relative to the axis of pivoting of the piston, to vary the stroke of an engine as the piston moves toward a bottom dead center position.
Figure 15B:
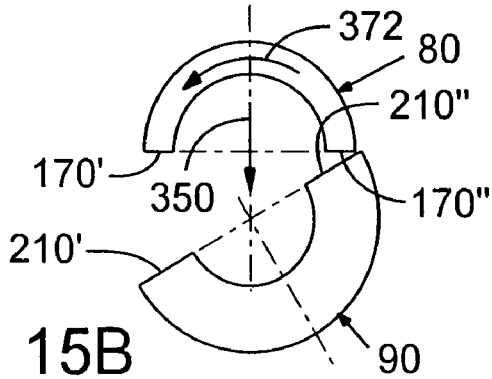
Figure 15C:
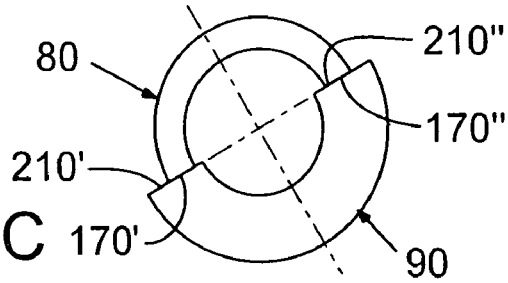
Figure 15D:
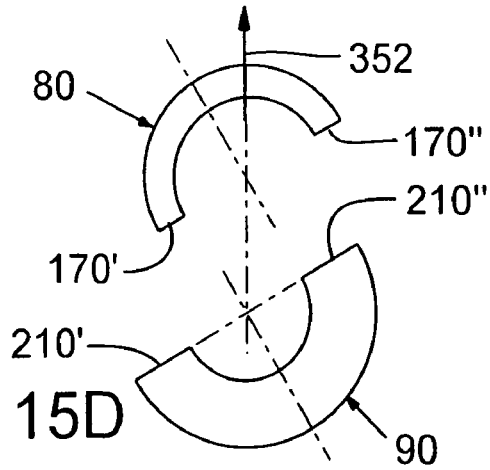

In FIG. 15A, assume that coupler 90 has been turned counterclockwise (in this example, in the direction of arrow 370) a certain amount to adjust the compression ratio. The amount of turning has been exaggerated in these figures for purposes of illustration. As the piston coupler 80 moves downwardly, as indicated by arrow 350, eventually (as shown in FIG. 15B), a portion of one of the coupler surfaces, in this example surface 170" engages a portion of one of the pivot member turning surfaces in this example surface 210". Continued downward movement of the piston results in rotation (pivoting) of the coupler (in this example in the direction of arrow 372). When in the bottom dead center position shown in FIG. 15C, the surfaces 170', 170" of the coupler have been rotated to a position that matches the position of the surfaces 210', 210" of the pivot member 90. As the piston moves upwardly, as indicated by arrow 352, and away from the bottom dead center position, the coupler 80 has been adjusted to vary the compression rate (note the position of surfaces 170', 170") and can be retained in adjustment by the friction brake as previously explained.

Figure 16A:
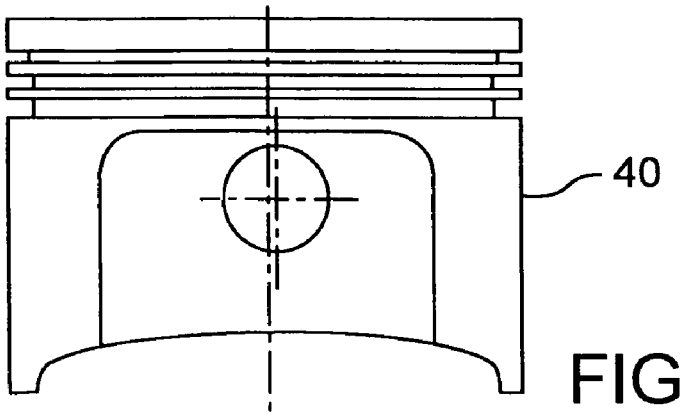
FIGS. 16A and 16B illustrate an exemplary relative position of the longitudinal centerline of a piston to fall between the maximum and minimum eccentric positions of the piston rod connection.
Figure 16B:
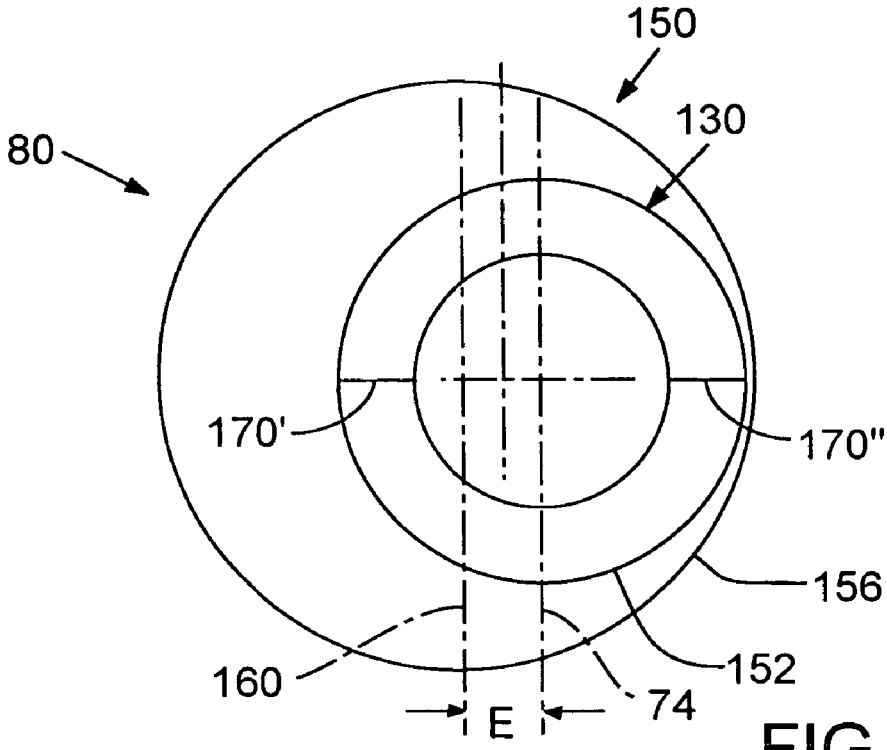

With reference to FIGS. 16A and 16B, a piston cylinder shown with a longitudinal centerline 400. The longitudinal centerline is desirably positioned between a first line parallel to the longitudinal centerline that intersects the first axis and a second line parallel to the longitudinal centerline that intersects the second axis when the eccentric portion is pivoted to the maximum allowed extent.

Figure 17:
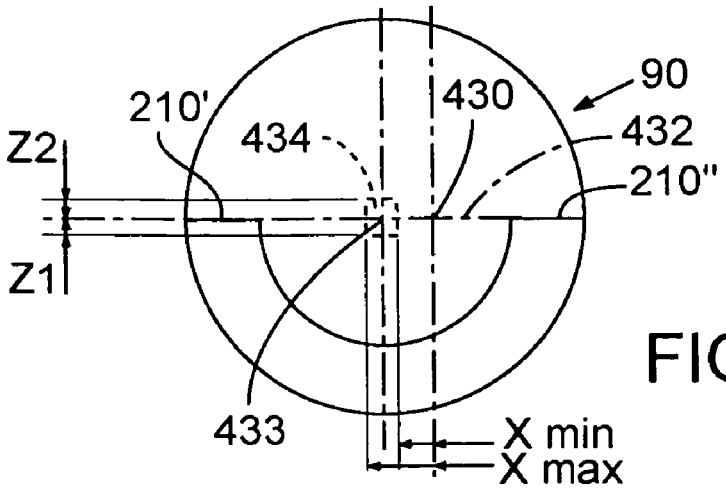
FIG. 17 schematically illustrates a desirable location for a pivot axis of an exemplary pivot member with engagement surfaces shown as flat surfaces aligned in this example along a bottom dead center position of the piston.

With reference to FIG. 17, a piston cylinder is illustrated with a longitudinal centerline and wherein the maximum eccentricity is defined as E and corresponds to the maximum offset between the first and second axes, wherein an origin of a reference coordinate system 430 is at the intersection of the longitudinal centerline of the at least one piston cylinder and a bottom dead centerline 432 corresponding the second axis when the second axis is in the bottom dead center position, wherein the Z dimension is along the longitudinal center line of the piston cylinder from the origin and the X dimension is along the bottom dead centerline from the origin, wherein the pivot member axis is parallel to the first axis and, wherein the pivot member axis (into the page and intersecting point 433) intersects an area 434 wherein X is from −0.5 E to −0.8 E and Z is from −0.25 E to 0.25 E.

Figure 18:
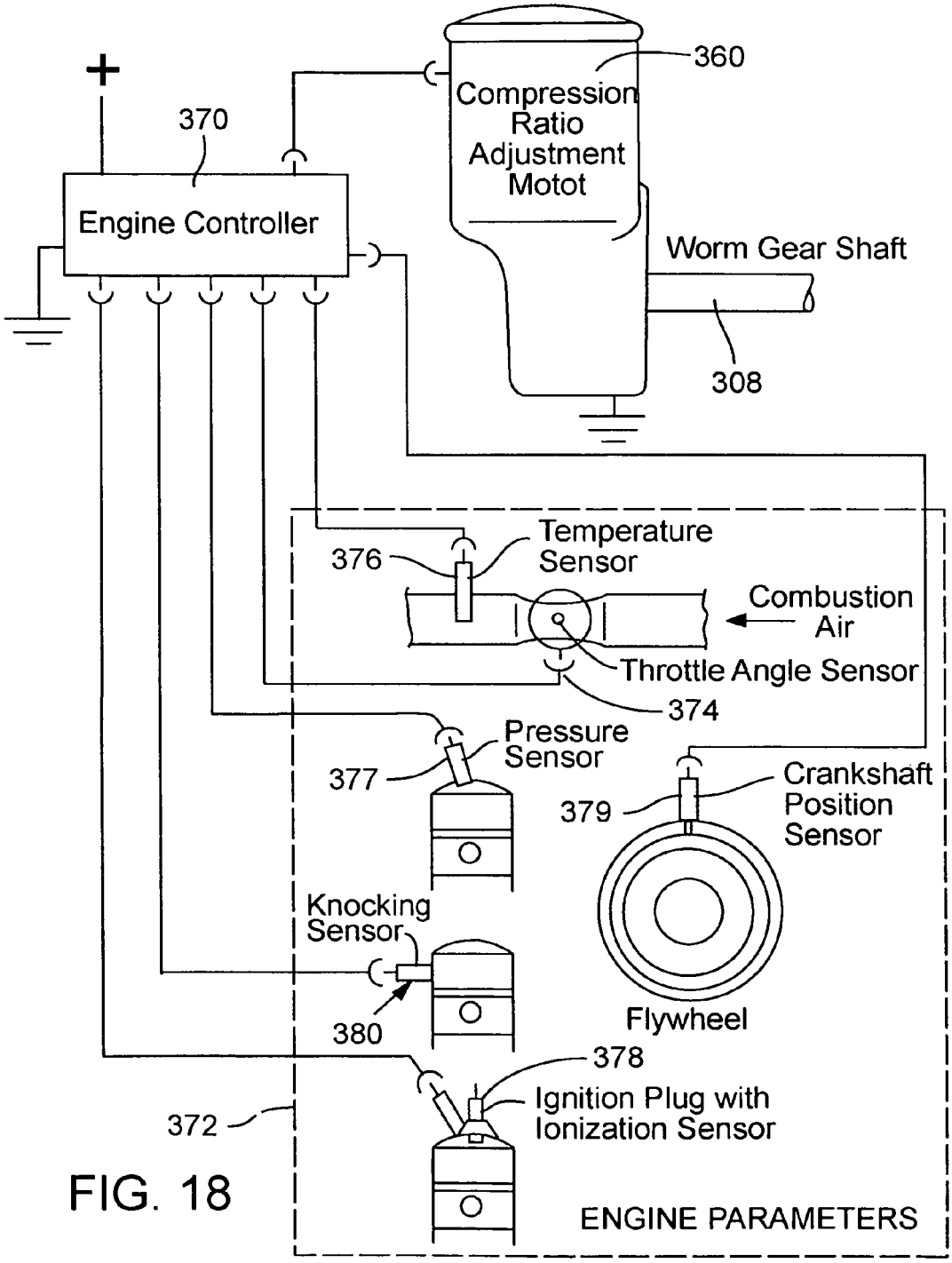
FIG. 18 illustrates an exemplary motor operable to control the pivoting of pivot members to vary the compression of the pistons and also illustrates exemplary control signals derived from exemplary engine parameters, one or more of which can be used to control the motor to thereby control the pivoting of pivot members and the compression ratio of the pistons.

With reference to FIG. 18, an exemplary motor 360 is shown for driving worm gear shaft 308 to pivot the pivot members and adjust the compression ratio of the engine such as previously described. Motor 360 can be a stepper motor or other form of motor and can provide feedback to an engine controller 370 which provides drive signals to the motor. Motor 360 is simply one example of a mechanism for driving a worm gear or other pivot member drive mechanism. Engine controller 370 can be a conventional engine controller, such as programmable controller, used in a vehicle which captures various vehicle parameter signals on a system bus utilized in the vehicle. These parameter signals can be used by the engine controller to generate motor control signals should conditions exist where it is desirable to selectively adjust the pivot members to vary the stroke of the piston cylinders. These control signals can be responsive to one or more engine operating parameters. Exemplary parameters are indicated within block 372, together with schematic illustrations of sensors for measuring the parameters. For example, a throttle angle sensor 374 can be used to deliver a throttle angle signal via a data bus to the engine controller. The motor 360 can drive worm gear 308 in clockwise or counterclockwise directions in response to control signals from the engine controller 370 in response to the throttle angle sensor signals. For example, under open throttle (full load) conditions, the compression ratio would typically be reduced. Under closed throttle (idle) conditions, the compression ratio would typically be increased. As another example, the combustion air temperature can be sensed by temperature sensor 376. In general, higher combustion air temperatures can be used to lower thresholds of alternatively used signals to control the motor to reduce the compression ratio. In contrast, lower temperature sensed signals can be used to increase the threshold to increase the compression ratio. As yet another example, a pressure sensor 377 can be used to sense the cylinder head pressure. Above a pre-defined pressure level at a certain crank shaft position, for example the top dead center position, the compression ratio would typically be decreased. Below this pre-determined pressure level, the compression ratio can be increased. The crank shaft position can be sensed by a crank shaft position sensor 379. As a further example, an ionization sensor, typically integrated into an ignition plug, senses in the moment of ignition the grade of the ionization of the air/fuel mixture of the internal combustion engine. Above a predetermined threshold, the compression ratio is typically decreased. Below the pre-determined threshold, the compression ratio is typically increased. An ignition plug with an ionization sensor is indicated at 378 in FIG. 18. As another alternative, a knocking sensor indicated schematically at 380, typically mounted to a cylinder block, senses vibration spikes caused by uncontrolled ignition of the combustion mix, corresponding to the engine knocking. In response to such signals, the engine controller 370 can control motor 360 to decrease the compression ratio. Control signals derived from combinations of sensed engine parameter conditions can also be used.

Having illustrated and described the principles of my invention with reference to exemplary embodiments, it should be apparent to those of ordinary skill in the art that these elements can be modified in arrangement and detail without departing from the inventive principles disclosed herein. I claim all such modifications.

I claim:

1. An internal combustion engine comprising:

a rotatable crank shaft;

at least one piston cylinder;

a piston slidably received by said at least one cylinder so as to reciprocate between top dead center and bottom dead center positions within said cylinder, the piston comprising a first piston coupler receiving bore that defines a first axis;

a connecting rod comprising a first crank coupling end portion pivotally coupled to the crank shaft such that rotation of the crank shaft causes the connecting rod to reciprocate, the connecting rod comprising a second piston coupling end portion comprising a second piston coupler receiving bore that defines a second axis;

a piston coupler comprising a first coupler portion pivotally received by said piston coupler receiving bore so as to be pivotable about the first axis, the piston coupler comprising a second coupler portion pivotally received by the second piston coupler receiving bore to couple the connecting rod to the piston such that reciprocation of the connecting rod causes the piston to reciprocate between the top dead center and bottom dead center position, one of the first and second coupler portions comprising an eccentric portion such that pivoting of the piston coupler about the first axis from a first coupler position to a second coupler position pivots the eccentric portion from a first eccentric position to a second eccentric position and shifts the second axis relative to the first axis to thereby vary the compression ratio of said at least one cylinder, the piston coupler also comprising a pivot member engager; and a pivot member comprising a pivot coupler engager movable from a first pivot coupler engager position to a second pivot coupler engager position, and the pivot member being positioned to engage the pivot member engager and to pivot the piston coupler while engaged with the pivot member engager from the first coupler position to the second coupler position as the piston approaches the bottom dead center position and in response to such movement of the pivot coupler engager from the first pivot coupler engager position to the second pivot coupler engager position, the pivot coupler engager also being operable to disengage the pivot member engager as the piston travels away from the bottom dead center position.

2. An internal combustion engine according to claim 1 wherein the pivot member is pivotable about a pivot member axis, the pivot member being pivotable about the pivot member axis from a first pivot member position to a second pivot member position to pivot the pivot coupler engager from the first pivot couple engager position to the second pivot coupler engager position, the piston coupler being pivoted from the first coupler position to the second coupler position as the piston approaches the bottom dead center position in response to the pivoting of the pivot coupler engager from the first pivot coupler engager position to the second pivot coupler engager position.

3. An internal combustion engine according to claim 2 wherein the pivot member engager comprises at least one pivot member engagement surface and wherein the pivot coupler engager comprises at least one pivot coupler engagement surface, the at least one pivot coupler engagement surface being pivoted from a first position to a second position in response to pivoting of the pivot member from the first pivot member position to the second pivot member position, the at least one pivot member engagement surface and at least one pivot coupler engagement surface being positioned to engage one another as the piston approaches the bottom dead center position to pivot the piston coupler from the first coupler position to the second coupler position in response to the pivoting of the at least one pivot coupler engagement surface from the pivot coupler engager first position to the pivot coupler engager second position.

4. An internal combustion engine according to claim 3 wherein the at least one pivot coupler engagement surface and the at least one pivot member engagement surface are flat surfaces.

5. An internal combustion engine according to claim 3 wherein the at least one pivot coupler engagement surface and the at least one pivot member engagement surface are planar surfaces.

6. An internal combustion engine according to claim 3 wherein there are two of said pivot member engagement surfaces positioned on opposite sides of the first axis and wherein there is a first set of two pivot coupler engagement surfaces on opposite sides of the pivot member axis.

7. An internal combustion engine according to claim 6 wherein said pivot coupler engagement surfaces and said pivot member engagement surfaces are flat.

8. An internal combustion engine according to claim 1 comprising a piston coupler retainer coupled to the piston coupler to apply a retention force that continually resists pivoting of the piston coupler relative to the piston.

9. An internal combustion engine according to claim 8 wherein the piston coupler retainer comprises a friction brake that applies braking force to resist pivoting of the piston coupler relative to the piston.

10. An internal combustion engine according to claim 9 comprising a brake force adjuster adapted to adjust the braking force.

11. An internal combustion engine according to claim 1 wherein the piston coupler is pivoted to a plurality of said first coupler positions; and a plurality of said second coupler positions, each different coupler position of the piston coupler corresponding to a respective eccentric position, and wherein the pivot coupler engager is movable from a plurality of first pivot coupler engager positions to a plurality of second pivot coupler engager positions to pivot the eccentric portion from any one of a plurality of first coupler positions to any one of a plurality of second coupler positions.

12. An internal combustion engine according to claim 1 wherein there are a plurality of first coupler engager positions and a plurality of second coupler engager positions.

13. An internal combustion engine according to claim 1 wherein the pivot member is adapted to pivot the pivot coupler between plural first and plural second pivot coupler positions, one of such pivot coupler positions corresponding to a minimum eccentricity position and another of such pivot coupler positions corresponding to a maximum eccentricity position of the eccentric portion, and other pivot coupler positions corresponding to eccentricity positions of the eccentric portion between the minimum and maximum eccentricity positions, and a piston coupler retainer coupled to the piston coupler and adapted to retain the piston coupler and eccentric portion in the position to which it is pivoted by the pivot coupler engager until the pivot member engager again pivots the piston coupler from a first position.

14. An internal combustion engine comprising:

a rotatable crank shaft;

at least one piston cylinder;

a piston slidably received by said at least one cylinder so as to reciprocate between top dead center and bottom dead center positions within said cylinder, the piston comprising a first piston coupler receiving bore that defines a first axis;

a connecting rod comprising a first crank coupling end portion pivotally coupled to the crank shaft such that rotation of the crank shaft causes the connecting rod to reciprocate, the connecting rod comprising a second piston coupling end portion comprising a second piston coupler receiving bore that defines a second axis;

a piston coupler comprising a first coupler portion pivotally received by said piston coupler receiving bore so as to be pivotable about the first axis, the piston coupler comprising a second coupler portion pivotally received by the second piston coupler receiving bore to couple the connecting rod to the piston such that reciprocation of the connecting rod causes the piston to reciprocate between the top dead center and bottom dead center position, one of the first and second coupler portions comprising an eccentric portion such that pivoting of the piston coupler about the first axis from a first coupler position to a second coupler position pivots the eccentric portion from a first eccentric position to a second eccentric position and shifts the second axis relative to the first axis to thereby vary the compression ratio of said at least one cylinder, the piston coupler also comprising a pivot member engager; and a pivot member comprising a pivot coupler engager movable from a first pivot coupler engager position to a second pivot coupler engager position and positioned to engage the pivot member engager to pivot the piston coupler from the first coupler position to the second coupler position as the piston approaches the bottom dead center position and in response to such movement of the pivot coupler engager from the first pivot coupler engager position to the second pivot coupler engager position, the pivot coupler engager also being operable to disengage the pivot member engager as the piston travels away from the bottom dead center position; and wherein the piston coupler comprises a piston pin pivotable about the first axis, and wherein the at least one piston comprises a body having an upper cylindrical piston ring supporting portion of a first diameter and a lower body portion sized to create a pivot member engager receiving space between the lower body portion and the at least one cylinder, one end portion of the piston pin extending outwardly from the lower body portion into the pivot member engager receiving space, said one end portion of the piston pin comprising the pivot member engager.

15. An internal combustion engine according to claim 14 wherein the pivot member engager comprises downwardly facing first and second pivot member engagement surfaces of said one end portion of the piston pin.

16. An internal combustion engine comprising:

a rotatable crank shaft;

at least one piston cylinder;

a piston slidably received by said at least one cylinder so as to reciprocate between top dead center and bottom dead center positions within said cylinder, the piston comprising a first piston coupler receiving bore that defines a first axis;

a connecting rod comprising a first crank coupling end portion pivotally coupled to the crank shaft such that rotation of the crank shaft causes the connecting rod to reciprocate, the connecting rod comprising a second piston coupling end portion comprising a second piston coupler receiving bore that defines a second axis;

a piston coupler comprising a first coupler portion pivotally received by said piston coupler receiving bore so as to be pivotable about the first axis, the piston coupler comprising a second coupler portion pivotally received by the second piston coupler receiving bore to couple the connecting rod to the piston such that reciprocation of the connecting rod causes the piston to reciprocate between the top dead center and bottom dead center position, one of the first and second coupler portions comprising an eccentric portion such that pivoting of the piston coupler about the first axis from a first coupler position to a second coupler position pivots the eccentric portion from a first eccentric position to a second eccentric position and shifts the second axis relative to the first axis to thereby vary the compression ratio of said at least one cylinder, the piston coupler also comprising a pivot member engager; and a pivot member comprising a pivot coupler engager movable from a first pivot coupler engager position to a second pivot coupler engager position and positioned to engage the pivot member engager to pivot the piston coupler from the first coupler position to the second coupler position as the piston approaches the bottom dead center position and in response to such movement of the pivot coupler engager from the first pivot coupler engager position to the second pivot coupler engager position, the pivot coupler engager also being operable to disengage the pivot member engager as the piston travels away from the bottom dead center position;

wherein the pivot member is pivotable about a pivot member axis, the pivot member being pivotable about the pivot member axis from a first pivot member position to a second pivot member position to pivot the pivot coupler engager from the first pivot couple engager position to the second pivot coupler engager position, the piston coupler being pivoted from the first coupler position to the second coupler position as the piston approaches the bottom dead center position in response to the pivoting of the pivot coupler engager from the first pivot coupler engager position to the second pivot coupler engager position;

wherein the pivot member engager comprises at least one pivot member engagement surface and wherein the pivot coupler engager comprises at least one pivot coupler engagement surface, the at least one pivot coupler engagement surface being pivoted from a first position to a second position in response to pivoting of the pivot member from the first pivot member position to the second pivot member position, the at least one pivot member engagement surface and at least one pivot coupler engagement surface being positioned to engage one another as the piston approaches the bottom dead center position to pivot the piston coupler from the first coupler position to the second coupler position in response to the pivoting of the at least one pivot coupler engagement surface from the pivot coupler engager first position to the pivot coupler engager second position;

wherein there are two of said pivot member engagement surfaces positioned on opposite sides of the first axis and wherein there is a first set of two pivot coupler engagement surfaces on opposite sides of the pivot member axis; and wherein there are first and second of said piston cylinders, a respective associated first piston slidably received by the first of said piston cylinders, and a respective associated second piston slidably received by the second of said piston cylinders, a respective connecting rod and piston coupler associated with and coupled to said first piston, a respective connecting rod and piston coupler associated with and coupled to the second piston, and wherein there is a common pivot member for engaging the piston couplers associated with the first and second pistons, the pivot member comprising a first set of two pivot coupler engagement surfaces for engaging the two pivot member engagement surfaces of the piston coupler associated with the first piston and a second set of two pivot coupler engagement surfaces for engaging the two pivot member engagement surfaces of the piston coupler associated with the second piston.

17. An internal combustion engine according to claim 16 wherein there is at least one additional of said piston cylinders and pistons in addition to the first and second pistons and first and second piston cylinders, said additional piston comprising an associated piston coupler, connecting rod and pivot member.

18. An internal combustion engine according to claim 16 wherein the common pivot member comprises a first pivot member end portion extending into a first region defined by the first cylinder and a second pivot member end portion extending into a second region defined by the second cylinder, a first bracket coupled to the first cylinder in a position to pivotally support the first pivot member end portions, a second bracket coupled to the second cylinder in a position to pivotally support the second pivot member end portion, the first and second brackets being fastened together with a portion of the first cylinder and a portion of the second cylinder positioned between the first and second brackets, the first and second brackets being shaped to provide clearance for the respective pivot member engagement surfaces and pivot coupler engagement surface to engage one another.

19. An internal combustion engine comprising:

a rotatable crank shaft;

at least one piston cylinder;

a piston slidably received by said at least one cylinder so as to reciprocate between top dead center and bottom dead center positions within said cylinder, the piston comprising a first piston coupler receiving bore that defines a first axis;

a connecting rod comprising a first crank coupling end portion pivotally coupled to the crank shaft such that rotation of the crank shaft causes the connecting rod to reciprocate, the connecting rod comprising a second piston coupling end portion comprising a second piston coupler receiving bore that defines a second axis;

a piston coupler comprising a first coupler portion pivotally received by said piston coupler receiving bore so as to be pivotable about the first axis, the piston coupler comprising a second coupler portion pivotally received by the second piston coupler receiving bore to couple the connecting rod to the piston such that reciprocation of the connecting rod causes the piston to reciprocate between the top dead center and bottom dead center position, one of the first and second coupler portions comprising an eccentric portion such that pivoting of the piston coupler about the first axis from a first coupler position to a second coupler position pivots the eccentric portion from a first eccentric position to a second eccentric position and shifts the second axis relative to the first axis to thereby vary the compression ratio of said at least one cylinder, the piston coupler also comprising a pivot member engager; and a pivot member comprising a pivot coupler engager movable from a first pivot coupler engager position to a second pivot coupler engager position and positioned to engage the pivot member engager to pivot the piston coupler from the first coupler position to the second coupler position as the piston approaches the bottom dead center position and in response to such movement of the pivot coupler engager from the first pivot coupler engager position to the second pivot coupler engager position, the pivot coupler engager also being operable to disengage the pivot member engager as the piston travels away from the bottom dead center position;

wherein the pivot member is pivotable about a pivot member axis, the pivot member being pivotable about the pivot member axis from a first pivot member position to a second pivot member position to pivot the pivot coupler engager from the first pivot couple engager position to the second pivot coupler engager position, the piston coupler being pivoted from the first coupler position to the second coupler position as the piston approaches the bottom dead center position in response to the pivoting of the pivot coupler engager from the first pivot coupler engager position to the second pivot coupler engager position;

wherein the pivot member engager comprises at least one pivot member engagement surface and wherein the pivot coupler engager comprises at least one pivot coupler engagement surface, the at least one pivot coupler engagement surface being pivoted from a first position to a second position in response to pivoting of the pivot member from the first pivot member position to the second pivot member position, the at least one pivot member engagement surface and at least one pivot coupler engagement surface being positioned to engage one another as the piston approaches the bottom dead center position to pivot the piston coupler from the first coupler position to the second coupler position in response to the pivoting of the at least one pivot coupler engagement surface from the pivot coupler engager first position to the pivot coupler engager second position; and comprising a worm gear drivenly coupled to said pivot member, a motor coupled to the worm gear and operable to pivot the pivot member from plural first positions to plural second positions to adjust the compression ratio to a plurality of values.

20. An internal combustion engine according to claim 19 wherein the pivot member defines a recess extending in a direction perpendicular to the pivot member axis, the worm gear being positioned at least partially in the recess and engaging the pivot member to restrict movement of the pivot member in either direction along the pivot member axis.

21. An internal combustion engine according to claim 19 wherein the worm gear engages the pivot member and restricts movement of the pivot member in either direction along the pivot member axis.

22. An internal combustion engine according to claim 19 wherein the worm gear is configured to restrict pivoting of the pivot member to be within a predetermined limit.

23. An internal combustion engine according to claim 22 wherein the predetermined limit is approximately one hundred and ten degrees, and wherein the center position of the limit corresponds to the pivot coupler being pivoted to a position that aligns the first axis and the second axis.

24. An internal combustion engine according to claim 22 further comprising a piston coupler retainer coupled to the piston coupler to apply a retention force to resist pivoting of the piston coupler, and wherein the piston coupler retainer also limits the pivoting of the pivot coupler about the first axis to be within a predetermined limit.

25. An internal combustion engine comprising:

a rotatable crank shaft;

at least one piston cylinder;

a piston slidably received by said at least one cylinder so as to reciprocate between top dead center and bottom dead center positions within said cylinder, the piston comprising a first piston coupler receiving bore that defines a first axis;

a connecting rod comprising a first crank coupling end portion pivotally coupled to the crank shaft such that rotation of the crank shaft causes the connecting rod to reciprocate, the connecting rod comprising a second piston coupling end portion comprising a second piston coupler receiving bore that defines a second axis;

a piston coupler comprising a first coupler portion pivotally received by said piston coupler receiving bore so as to be pivotable about the first axis, the piston coupler comprising a second coupler portion pivotally received by the second piston coupler receiving bore to couple the connecting rod to the piston such that reciprocation of the connecting rod causes the piston to reciprocate between the top dead center and bottom dead center position, one of the first and second coupler portions comprising an eccentric portion such that pivoting of the piston coupler about the first axis from a first coupler position to a second coupler position pivots the eccentric portion from a first eccentric position to a second eccentric position and shifts the second axis relative to the first axis to thereby vary the compression ratio of said at least one cylinder, the piston coupler also comprising a pivot member engager;

a pivot member comprising a pivot coupler engager movable from a first pivot coupler engager position to a second pivot coupler engager position and positioned to engage the pivot member engager to pivot the piston coupler from the first coupler position to the second coupler position as the piston approaches the bottom dead center position and in response to such movement of the pivot coupler engager from the first pivot coupler engager position to the second pivot coupler engager position, the pivot coupler engager also being operable to disengage the pivot member engager as the piston travels away from the bottom dead center position; and wherein there are a plurality of said piston cylinders, pistons, piston couplers, connecting rods and pivot members, a single worm gear drive motor, and a plurality of worm gears for pivoting said pivot members in response to the operation of said worm gear drive motor.

26. An internal combustion engine according to claim 25 wherein there is at least one pivot member operable to pivot the pivot coupler of more than one piston.

27. An internal combustion engine comprising:

a rotatable crank shaft;

at least one piston cylinder; a piston slidably received by said at least one cylinder so as to reciprocate between top dead center and bottom dead center positions within said cylinder, the piston comprising a first piston coupler receiving bore that defines a first axis;

a connecting rod comprising a first crank coupling end portion pivotally coupled to the crank shaft such that rotation of the crank shaft causes the connecting rod to reciprocate, the connecting rod comprising a second piston coupling end portion comprising a second piston coupler receiving bore that defines a second axis;

a piston coupler comprising a first coupler portion pivotally received by said piston coupler receiving bore so as to be pivotable about the first axis, the piston coupler comprising a second coupler portion pivotally received by the second piston coupler receiving bore to couple the connecting rod to the piston such that reciprocation of the connecting rod causes the piston to reciprocate between the top dead center and bottom dead center position, one of the first and second coupler portions comprising an eccentric portion such that pivoting of the piston coupler about the first axis from a first coupler position to a second coupler position pivots the eccentric portion from a first eccentric position to a second eccentric position and shifts the second axis relative to the first axis to thereby vary the compression ratio of said at least one cylinder, the piston coupler also comprising a pivot member engager;

a pivot member comprising a pivot coupler engager movable from a first pivot coupler engager position to a second pivot coupler engager position and positioned to engage the pivot member engager to pivot the piston coupler from the first coupler position to the second coupler position as the piston approaches the bottom dead center position and in response to such movement of the pivot coupler engager from the first pivot coupler engager position to the second pivot coupler engager position, the pivot coupler engager also being operable to disengage the pivot member engager as the piston travels away from the bottom dead center position; and wherein the piston coupler comprises a piston pin comprising first and third portions and a second portion intermediate to the first and third portions, the first and third portions having longitudinal centerlines that are aligned with the first axis, the second portion comprising the eccentric portion and having a longitudinal center line that is aligned with the second axis, the first, second and third portions comprising right cylindrical surfaces of respective first, second and third diameters, wherein the pivot member engager comprises an end portion of the first portion of the piston pin.

28. An internal combustion engine according to claim 27 wherein the first diameter is greater than the second diameter and wherein the second diameter is greater than the third diameter, the first piston coupler receiving bore having a first bore portion sized to receive the first piston portion and a second bore portion sized to receive the third bore portion, the second coupler receiving bore being sized to receive the second piston portion, the piston pin being restricted against travel along the first axis in one direction by the first portion being of a sufficient cross sectional dimension to prevent the passage of the first piston pin portion through a pin receiving opening through the second piston coupling end portion, a friction brake coupled to the third portion of the piston pin and to the piston to resist relative pivoting motion between the piston pin and piston about the first axis, the friction brake being operable to prevent the piston pin from moving along the first axis in a direction opposite to said one direction.

29. An internal combustion engine according to claim 28 wherein the pivot member engager comprises at least one pivot member engagement surface and wherein the pivot coupler engager comprises at least one pivot coupler engagement surface, the at least one pivot coupler engagement surface being pivoted from a first position to a second position in response to pivoting of the pivot member from the first pivot member position to the second pivot member position, the at least one pivot member engagement surface and at least one pivot coupler engagement surface being positioned to engage one another as the piston approaches the bottom dead center position to pivot the piston coupler from the first coupler position to the second coupler position in response to the pivoting of the at least one pivot coupler engagement surface from the pivot coupler engager first position to the pivot coupler engager second position;

a worm gear drivenly coupled to said pivot member, a motor coupled to the worm gear and operable to pivot the pivot member from plural first positions to plural second positions to adjust the compression ratio to a plurality of values; and wherein the worm gear engages the pivot member and restricts movement of the pivot member in either direction along the pivot member axis.

30. An internal combustion engine according to claim 27 wherein the first diameter is equal to the third diameter and the second diameter is greater than the first and third diameters, the first piston coupler receiving bore comprising right cylindrical first and second piston bore portions having a diameter that is greater than the second diameter such that the piston pin is insertable in one direction through the first piston bore portion, the piston coupler receiving bore and the second piston bore portion, a first bushing mounted to the first piston pin portion and positioned within the first piston bore portion and second bushing mounted to the third piston pin portion and positioned within the second piston bore portion, the first and second bushings restricting the piston pin against motion along the first axis.

31. An internal combustion engine according to claim 30 wherein the pivot member engager comprises at least one pivot member engagement surface and wherein the pivot coupler engager comprises at least one pivot coupler engagement surface, the at least one pivot coupler engagement surface being pivoted from a first position to a second position in response to pivoting of the pivot member from the first pivot member position to the second pivot member position, the at least one pivot member engagement surface and at least one pivot coupler engagement surface being positioned to engage one another as the piston approaches the bottom dead center position to pivot the piston coupler from the first coupler position to the second coupler position in response to the pivoting of the at least one pivot coupler engagement surface from the pivot coupler engager first position to the pivot coupler engager second position;

a worm gear drivenly coupled to said pivot member, a motor coupled to the worm gear and operable to pivot the pivot member from plural first positions to plural second positions to adjust the compression ratio to a plurality of values; and wherein the worm gear engages the pivot member and restricts movement of the pivot member in either direction along the pivot member axis.

32. An internal combustion engine comprising:

a rotatable crank shaft;

at least one piston cylinder;

a piston slidably received by said at least one cylinder so as to reciprocate between top dead center and bottom dead center positions within said cylinder, the piston comprising a first piston coupler receiving bore that defines a first axis;

a connecting rod comprising a first crank coupling end portion pivotally coupled to the crank shaft such that rotation of the crank shaft causes the connecting rod to reciprocate, the connecting rod comprising a second piston coupling end portion comprising a second piston coupler receiving bore that defines a second axis;

a piston coupler comprising a first coupler portion pivotally received by said piston coupler receiving bore so as to be pivotable about the first axis, the piston coupler comprising a second coupler portion pivotally received by the second piston coupler receiving bore to couple the connecting rod to the piston such that reciprocation of the connecting rod causes the piston to reciprocate between the top dead center and bottom dead center position, one of the first and second coupler portions comprising an eccentric portion such that pivoting of the piston coupler about the first axis from a first coupler position to a second coupler position pivots the eccentric portion from a first eccentric position to a second eccentric position and shifts the second axis relative to the first axis to thereby vary the compression ratio of said at least one cylinder, the piston coupler also comprising a pivot member engager;

a pivot member comprising a pivot coupler engager movable from a first pivot coupler engager position to a second pivot coupler engager position and positioned to engage the pivot member engager to pivot the piston coupler from the first coupler position to the second coupler position as the piston approaches the bottom dead center position and in response to such movement of the pivot coupler engager from the first pivot coupler engager position to the second pivot coupler engager position, the pivot coupler engager also being operable to disengage the pivot member engager as the piston travels away from the bottom dead center position;

wherein the pivot member is pivotable about a pivot member axis, the pivot member being pivotable about the pivot member axis from a first pivot member position to a second pivot member position to pivot the pivot coupler engager from the first pivot couple engager position to the second pivot coupler engager position, the piston coupler being pivoted from the first coupler position to the second coupler position as the piston approaches the bottom dead center position in response to the pivoting of the pivot coupler engager from the first pivot coupler engager position to the second pivot coupler engager position; and wherein the piston cylinder has a longitudinal centerline and wherein the maximum eccentricity is defined as E and corresponds to the maximum offset between the first and second axes, wherein an origin of a reference coordinate system is at the intersection of the longitudinal centerline of the at least one piston cylinder and a bottom dead centerline corresponding the second axis when the second axis is in the bottom dead center position, wherein the Z dimension is along the longitudinal center line of the piston cylinder from the origin and the X dimension is along the bottom dead centerline from the origin, wherein the pivot member axis is parallel to the first axis and, wherein the pivot member axis intersects an area wherein X is from −0.5 E to −0.8 E and Z is from −0.25 E to 0.25 E.

33. An internal combustion engine comprising:

a rotatable crank shaft;

at least one piston cylinder;

a piston slidably received by said at least one cylinder so as to reciprocate between top dead center and bottom dead center positions within said cylinder, the piston comprising a first piston coupler receiving bore that defines a first axis;

a connecting rod comprising a first crank coupling end portion pivotally coupled to the crank shaft such that rotation of the crank shaft causes the connecting rod to reciprocate, the connecting rod comprising a second piston coupling end portion comprising a second piston coupler receiving bore that defines a second axis;

a piston coupler comprising a first coupler portion pivotally received by said piston coupler receiving bore so as to be pivotable about the first axis the piston coupler comprising a second coupler portion pivotally received by the second piston coupler receiving bore to couple the connecting rod to the piston such that reciprocation of the connecting rod causes the piston to reciprocate between the top dead center and bottom dead center position, one of the first and second coupler portions comprising an eccentric portion such that pivoting of the piston coupler about the first axis from a first coupler position to a second coupler position pivots the eccentric portion from a first eccentric position to a second eccentric position and shifts the second axis relative to the first axis to thereby vary the compression ratio of said at least one cylinder, the piston coupler also comprising a pivot member engager; and a pivot member comprising a pivot coupler engager movable from a first pivot coupler engager position to a second pivot coupler engager position and positioned to engage the pivot member engager to pivot the piston coupler from the first coupler position to the second coupler position as the piston approaches the bottom dead center position and in response to such movement of the pivot coupler engager from the first pivot coupler engager position to the second pivot coupler engager position, the pivot coupler engager also being operable to disengage the pivot member engager as the piston travels away from the bottom dead center position;

wherein the pivot member is pivotable about a pivot member axis, the pivot member being pivotable about the pivot member axis from a first pivot member position to a second pivot member position to pivot the pivot coupler engager from the first pivot couple engager position to the second pivot coupler engager position, the piston coupler being pivoted from the first coupler position to the second coupler position as the piston approaches the bottom dead center position in response to the pivoting of the pivot coupler engager from the first pivot coupler engager position to the second pivot coupler engager position; and wherein the piston cylinder has a longitudinal centerline, wherein the longitudinal centerline is positioned between a first line parallel to the longitudinal centerline that intersects the first axis and a second line parallel to the longitudinal centerline that intersects the second axis when the eccentric portion is pivoted to the maximum allowed extent.

34. An internal combustion engine comprising:

a rotatable crank shaft;

at least one piston cylinder;

a piston slidably received by said at least one cylinder so as to reciprocate between top dead center and bottom dead center positions within said cylinder, the piston comprising a first piston coupler receiving bore that defines a first axis;

a connecting rod comprising a first crank coupling end portion pivotally coupled to the crank shaft such that rotation of the crank shaft causes the connecting rod to reciprocate, the connecting rod comprising a second piston coupling end portion comprising a second piston coupler receiving bore that defines a second axis;

a piston coupler comprising a first coupler portion pivotally received by said piston coupler receiving bore so as to be pivotable about the first axis, the piston coupler comprising a second coupler portion pivotally received by the second piston coupler receiving bore to couple the connecting rod to the piston such that reciprocation of the connecting rod causes the piston to reciprocate between the top dead center and bottom dead center position, one of the first and second coupler portions comprising an eccentric portion such that pivoting of the piston coupler about the first axis from a first coupler position to a second coupler position pivots the eccentric portion from a first eccentric position to a second eccentric position and shifts the second axis relative to the first axis to thereby vary the compression ratio of said at least one cylinder, the piston coupler also comprising a pivot member engager;

a pivot member comprising a pivot coupler engager movable from a first pivot coupler engager position to a second pivot coupler engager position and positioned to engage the pivot member engager to pivot the piston coupler from the first coupler position to the second coupler position as the piston approaches the bottom dead center position and in response to such movement of the pivot coupler engager from the first pivot coupler engager position to the second pivot coupler engager position, the pivot coupler engager also being operable to disengage the pivot member engager as the piston travels away from the bottom dead center position;

wherein the pivot member is pivotable about a pivot member axis, the pivot member being pivotable about the pivot member axis from a first pivot member position to a second pivot member position to pivot the pivot coupler engager from the first pivot couple engager position to the second pivot coupler engager position, the piston coupler being pivoted from the first coupler position to the second coupler position as the piston approaches the bottom dead center position in response to the pivoting of the pivot coupler engager from the first pivot coupler engager position to the second pivot coupler engager position; and wherein the maximum eccentricity is defined as E and corresponds to the maximum offset between the first and second axes arising from pivoting the eccentric portion, wherein the piston coupler comprises a piston pin comprising first and third portions and a second portion intermediate the first and third portions, the first and third portions having longitudinal centerlines that are aligned with the first axis, the second portion comprising the eccentric portion and having a longitudinal center line that is aligned with the second axis, the first, second and third portions comprising right cylindrical surfaces, the second portion having a right cylindrical surface of a first radius defined as $R_{CR}$, one of the first and third portions having a right cylindrical surface of a radius $R_1$, wherein $R_1 \leqq (R_{CR}+E)$, and the other of the first and third portions having a right cylindrical surface of a radius $R_2$, wherein $R_2 \leqq (R_{CR}-E)$.

35. An internal combustion engine comprising:

a rotatable crank shaft;

at least one piston cylinder;

a piston slidably received by said at least one cylinder so as to reciprocate between top dead center and bottom dead center positions within said cylinder, the piston comprising a first piston coupler receiving bore that defines a first axis;

a connecting rod comprising a first crank coupling end portion pivotally coupled to the crank shaft such that rotation of the crank shaft causes the connecting rod to reciprocate, the connecting rod comprising a second piston coupling end portion comprising a second piston coupler receiving bore that defines a second axis;

a piston coupler comprising a first coupler portion pivotally received by said piston coupler receiving bore so as to be pivotable about the first axis, the piston coupler comprising a second coupler portion pivotally received by the second piston coupler receiving bore to couple the connecting rod to the piston such that reciprocation of the connecting rod causes the piston to reciprocate between the top dead center and bottom dead center position, one of the first and second coupler portions comprising an eccentric portion such that pivoting of the piston coupler about the first axis from a first coupler position to a second coupler position pivots the eccentric portion from a first eccentric position to a second eccentric position and shifts the second axis relative to the first axis to thereby vary the compression ratio of said at least one cylinder, the piston coupler also comprising a pivot member engager;

a pivot member comprising a pivot coupler engager movable from a first pivot coupler engager position to a second pivot coupler engager position and positioned to engage the pivot member engager to pivot the piston coupler from the first coupler position to the second coupler position as the piston approaches the bottom dead center position and in response to such movement of the pivot coupler engager from the first pivot coupler engager position to the second pivot coupler engager position, the pivot coupler engager also being operable to disengage the pivot member engager as the piston travels away from the bottom dead center position;

further comprising a piston coupler retainer coupled to the piston coupler to apply a retention force that resists pivoting of the piston coupler relative to the piston; and wherein the piston coupler defines a piston coupler braking surface, and wherein the piston coupler retainer comprises a spring biased friction brake coupled to the at least one piston and comprising a friction brake braking surface positioned to frictionally engage the piston coupler braking surface.

36. An internal combustion engine according to claim 35 wherein each of the piston coupler braking surface and friction brake braking surface is at least partially conical, the piston coupler comprising a piston pin with first and second end portions, the first end portion comprising a brake receiving first cavity defining the piston coupler braking surface, the friction brake being inserted at least partially into the brake receiving cavity.

37. An internal combustion engine according to claim 36 wherein the second end portion of the piston pin defines a second cavity that is at least partially conical, the pivot member engager comprising an outwardly projecting portion of the second end portion of the piston pin.

38. An internal combustion engine according to claim 37 further comprising an internal cavity interconnecting the first and second cavities, the internal cavity and the first and second cavities being shaped and dimensioned to achieve a homogenous bending line in response to the application of force by the piston to the piston pin and the counterforce applied by the connecting rod during operation of the engine.

39. An internal combustion engine according to claim 35 wherein the piston coupler comprises a first end portion comprising the piston coupler braking surface and a second end portion, the pivot member engager comprising an outwardly projecting portion of the second end portion.

40. An internal combustion engine according to claim 35 wherein the friction brake comprises a stop portion positioned to engage the piston coupler to limit the extent of pivoting of the piston coupler to within a predetermined limit.

41. An internal combustion engine comprising:

a rotatable crank shaft;

at least one piston cylinder;

a piston slidably received by said at least one cylinder so as to reciprocate between top dead center and bottom dead center positions within said cylinder, the piston comprising a first piston coupler receiving bore that defines a first axis;

a connecting rod comprising a first crank coupling end portion pivotally coupled to the crank shaft such that rotation of the crank shaft causes the connecting rod to reciprocate, the connecting rod comprising a second piston coupling end portion comprising a second piston coupler receiving bore that defines a second axis;

a piston coupler comprising a first coupler portion pivotally received by said piston coupler receiving bore so as to be pivotable about the first axis, the piston coupler comprising a second coupler portion pivotally received by the second piston coupler receiving bore to couple the connecting rod to the piston such that reciprocation of the connecting rod causes the piston to reciprocate between the top dead center and bottom dead center position, one of the first and second coupler portions comprising an eccentric portion such that pivoting of the piston coupler about the first axis from a first coupler position to a second coupler position pivots the eccentric portion from a first eccentric position to a second eccentric position and shifts the second axis relative to the first axis to thereby vary the compression ratio of said at least one cylinder, the piston coupler also comprising a pivot member engager;

a pivot member comprising a pivot coupler engager movable from a first pivot coupler engager position to a second pivot coupler engager position and positioned to engage the pivot member engager to pivot the piston coupler from the first coupler position to the second coupler position as the piston approaches the bottom dead center position and in response to such movement of the pivot coupler engager from the first pivot coupler engager position to the second pivot coupler engager position, the pivot coupler engager also being operable to disengage the pivot member engager as the piston travels away from the bottom dead center position; and wherein the pivot member engager comprises an outwardly projecting portion of the pivot coupler.

42. An internal combustion engine comprising:

a rotatable crank shaft;

at least one piston cylinder;

a piston slidably received by said at least one cylinder so as to reciprocate between top dead center and bottom dead center positions within said cylinder, the piston comprising a first piston coupler receiving bore defining a first axis;

a connecting rod comprising a first crank coupling end portion pivotally coupled to the crank shaft such that rotation of the crank shaft causes the connecting rod to reciprocate, the connecting rod comprising a second piston coupling end portion comprising a second piston coupler receiving bore defining a second axis;

a piston coupler pivotably received by said piston coupler receiving bore so as to be pivotable about the first axis, the piston coupler comprising an eccentric portion pivotally received by the second piston coupler receiving bore to couple the connecting rod to the piston such that reciprocation of the connecting rod causes the piston to reciprocate between the top dead center and bottom dead center position, and such that pivoting of the piston coupler about the first axis from a first pivot coupler position to a second coupler position pivots the eccentric portion from a first eccentric position to a second eccentric position and shifts the second axis relative to the first axis to thereby vary the compression ratio of said at least one cylinder, the piston coupler also comprising a pivot member engager; and a pivot member comprising a pivot coupler engager movable from a first pivot coupler engager position to a second pivot coupler engager position and positioned to engage the pivot member engager to pivot the piston coupler from the first coupler position to the second coupler position as the piston approaches the bottom dead center position and in response to such movement of the first pivot coupler engager from the first pivot coupler engager position to the second pivot coupler engager position, the pivot coupler engager also being operable to disengage the pivot member engager as the piston travels away from the bottom dead center position;

wherein the piston coupler comprises a piston pin comprising first and third portions and a second portion intermediate to the first and third portions, the first and third portions having longitudinal centerlines that are aligned with the first axis, the second portion comprising the eccentric portion and having a longitudinal center line that is aligned with the second axis, the first, second and third portions comprising right cylindrical surfaces of respective first, second and third diameters, wherein the pivot member engager comprises an end portion of the first portion of the piston pin; and wherein the first diameter is equal to the third diameter and the second diameter is greater than the first and third diameters, the first piston coupler receiving bore comprising right cylindrical first and second piston bore portions having a diameter that is greater than the second diameter such that the piston pin is insertable in one direction through the first piston bore portion, the piston coupler receiving bore and the second piston bore portion, a first bushing mounted to the first piston pin portion and positioned within the first piston bore portion and second bushing mounted to the third piston pin portion and positioned within the second piston bore portion, the first and second bushings restricting the piston pin against motion along the first axis.

43. An internal combustion engine according to claim 42 further comprising a friction brake coupled to the piston pin and to the at least one piston to apply a retention force to resist pivoting of the piston coupler relative to the at least one piston.

44. An internal combustion engine comprising:

a rotatable crank shaft;

at least one piston cylinder;

a piston slidably received by said at least one cylinder so as to reciprocate between top dead center and bottom dead center positions within said cylinder, the piston comprising a first piston coupler receiving bore defining a first axis;

a connecting rod comprising a first crank coupling end portion pivotally coupled to the crank shaft such that rotation of the crank shaft causes the connecting rod to reciprocate, the connecting rod comprising a second piston coupling end portion comprising a second piston coupler receiving bore defining a second axis;

a piston coupler pivotably received by said piston coupler receiving bore so as to be pivotable about the first axis, the piston coupler comprising an eccentric portion pivotally received by the second piston coupler receiving bore to couple the connecting rod to the piston such that reciprocation of the connecting rod causes the piston to reciprocate between the top dead center and bottom dead center position, and such that pivoting of the piston coupler about the first axis from a first pivot coupler position to a second coupler position pivots the eccentric portion from a first eccentric position to a second eccentric position and shifts the second axis relative to the first axis to thereby vary the compression ratio of said at least one cylinder, the piston coupler also comprising a pivot member engager;

a pivot member comprising a pivot coupler engager movable from a first pivot coupler engager position to a second pivot coupler engager position and positioned to engage the pivot member engager to pivot the piston coupler from the first coupler position to the second coupler position as the piston approaches the bottom dead center position and in response to such movement of the first pivot coupler engager from the first pivot coupler engager position to the second pivot coupler engager position, the pivot coupler engager also being operable to disengage the pivot member engager as the piston travels away from the bottom dead center position;

wherein the pivot member is pivotable about a pivot member axis, the pivot member being pivotable about the pivot member axis from a first pivot member position to a second pivot member position to pivot the pivot coupler engager from the first pivot couple engager position to the second pivot coupler engager position, the piston coupler being pivoted from the first coupler position to the second coupler position as the piston approaches the bottom dead center position in response to the pivoting of the pivot coupler engager from the first pivot coupler engager position to the second pivot coupler engager position;

wherein the pivot member engager comprises at least one pivot member engagement surface and wherein the pivot coupler engager comprises at least one pivot coupler engagement surface, the at least one pivot coupler engagement surface being pivoted from a first position to a second position in response to pivoting of the pivot member from the first pivot member position to the second pivot member position, the at least one pivot member engagement surface and at least one pivot coupler engagement surface being positioned to engage one another as the piston approaches the bottom dead center position to pivot the piston coupler from the first coupler position to the second coupler position in response to the pivoting of the at least one pivot coupler engagement surface from the pivot coupler engager first position to the pivot coupler engager second position;

wherein there are two of said pivot member engagement surfaces positioned on opposite sides of the first axis and wherein there is a first set of two pivot coupler engagement surfaces on opposite sides of the pivot member axis;

wherein the piston coupler comprises a piston pin pivotable about the first axis, and wherein the at least one piston comprises a body having an upper cylindrical piston ring supporting portion of a first diameter and a lower body portion sized to create a pivot member engager receiving space between the lower body portion and the at least one cylinder, one end portion of the piston pin extending outwardly from the lower body portion into the pivot member engager receiving space, said one end portion of the piston pin comprising the pivot member engager;

wherein there are first and second of said piston cylinders, a respective associated first piston slidably received by the first of said piston cylinders, and a respective associated second piston slidably received by the second of said piston cylinders, a respective connecting rod and piston coupler associated with and coupled to said first piston, a respective connecting rod and piston coupler associated with and coupled to the second piston, and wherein there is a common pivot member for engaging the piston couplers associated with the first and second pistons, the pivot member comprising a first set of two pivot coupler engagement surfaces for engaging the two pivot member engagement surfaces of the piston coupler associated with the first piston and a second set of two pivot coupler engagement surfaces for engaging the two pivot member engagement surfaces of the piston coupler associated with the second piston;

a worm gear drivenly coupled to said pivot member, a motor coupled to the worm gear and operable to pivot the pivot member from plural first positions to plural second positions to adjust the compression ratio to a plurality of values;

wherein the worm gear engages the pivot member and restricts movement of the pivot member in either direction along the pivot member axis;

wherein the piston pin comprises first and third portions and a second portion intermediate to the first and third portions, the first and third portions having longitudinal centerlines that are aligned with the first axis, the second portion comprising the eccentric portion and having a longitudinal center line that is aligned with the second axis, the first, second and third portions comprising right cylindrical surfaces of respective first, second and third diameters, wherein the pivot member engager comprises an end portion of the first portion of the piston pin; and a piston coupler retainer coupled to the piston coupler to apply a retention force that resists pivoting of the piston coupler relative to the piston.

45. An internal combustion engine according to claim 34 wherein the third portion of the piston pin defines a piston coupler braking surface, and wherein the piston coupler retainer comprises a spring biased friction brake coupled to the at least one piston and comprising a friction brake braking surface positioned to frictionally engage the piston coupler braking surface;

wherein each of the piston coupler braking surface and friction brake braking surface is at least partially conical, the third portion of the piston pin defines a brake receiving first cavity that comprises the piston coupler braking surface, the friction brake being inserted at least partially into the brake receiving cavity;

wherein the first portion of the piston pin defines a second cavity that is at least partially conical, the pivot member engager comprising an outwardly projecting portion of the first piston pin end portion; and the piston pin further comprising an internal cavity interconnecting the first and second cavities, the internal cavity and the first and second cavities being shaped and dimensioned to achieve a homogenous bending line in response to the application of force by the piston to the piston pin and the counterforce applied by the connecting rod during operation of the engine.

46. An internal combustion engine according to claim 34 wherein the piston cylinder has a longitudinal centerline and wherein the maximum eccentricity is defined as E and corresponds to the maximum offset between the first and second axes, wherein an origin of a reference coordinate system is at the intersection of the longitudinal centerline of the at least one piston cylinder and a bottom dead centerline corresponding the second axis when the second axis is in the bottom dead center position, wherein the Z dimension is along the longitudinal center line of the piston cylinder from the origin and the X dimension is along the bottom dead centerline from the origin, wherein the pivot member axis is parallel to the first axis and, wherein the pivot member axis intersects an area wherein X is from −0.5 E to −0.8 E and Z is from −0.25 E to 0.25 E.

47. An internal combustion engine according to claim 44 wherein the piston cylinder has a longitudinal centerline, wherein the longitudinal centerline is positioned between a first line parallel to the longitudinal centerline that intersects the first axis and a second line parallel to the longitudinal centerline that intersects the second axis when the eccentric portion is pivoted to the maximum allowed extent.

48. An internal combustion engine according to claim 44 wherein the maximum eccentricity is defined as E and corresponds to the maximum offset between the first and second axes arising from pivoting the eccentric portion, the first, second and third portions comprising right cylindrical surfaces, the second portion having a right cylindrical surface of a first diameter defined as $R_{CR}$, one of the first and third portions having a right cylindrical surface of a diameter $R_1$, wherein $R_1 \geqq (R_{CR}+E)$, and the other of the first and third portions having a right cylindrical surface of a diameter $R_2$, wherein $R_2 \leqq (R_{CR}-E)$.

49. A method of adjusting the compression ratio of an internal combustion engine comprising:

reciprocating a piston in a cylinder between a top position and a bottom dead center position;

engaging and turning a piston coupler that has an eccentric coupling the piston to a connecting rod to adjust the top position and thereby the compression ratio, the act of engaging and turning the piston coupler comprising engaging and turning the piston coupler as the piston approaches the bottom dead center position;

disengaging the piston coupler as the piston leaves the bottom dead center position; and retaining the piston coupler in the position to which it has been turned when the piston coupler is disengaged.

50. A method according to claim 49 comprising the act of applying a brake to the piston coupler to resist movement of the piston coupler from the position to which it has been turned during the said engaging and turning act.

51. A method according to claim 49 comprising turning the piston coupler to and retaining the position coupler in a position that is in a range of positions from a minimum eccentricity position to a maximum eccentricity position, including eccentricity positions between the maximum and minimum eccentricity positions.

* * * * *